United States Patent [19]

Lieder et al.

[11] 4,182,094

[45] Jan. 8, 1980

[54] BAG OPENING AND FILLING APPARATUS

[75] Inventors: Gaylerd M. Lieder; Richard H. Ayres, both of Minneapolis, Minn.

[73] Assignee: Bemis Company, Inc., Minneapolis, Minn.

[21] Appl. No.: 886,800

[22] Filed: Mar. 15, 1978

[51] Int. Cl.[2] ..... B65B 57/02; B65B 43/30

[52] U.S. Cl. ..... 53/67; 53/571; 53/386; 271/227

[58] Field of Search ..... 53/67, 570, 571, 573, 53/386; 271/227, 228

[56] References Cited

U.S. PATENT DOCUMENTS

| | | | |
|---|---|---|---|
| 3,727,373 | 4/1973 | MacLeod | 53/386 X |
| 3,830,038 | 8/1974 | Propst | 53/386 X |
| 3,934,388 | 1/1976 | Stadlbauer et al. | 53/386 X |
| 3,945,173 | 3/1976 | Buzzi | 53/571 X |
| 4,078,358 | 3/1978 | Henderson | 53/386 X |

*Primary Examiner*—Travis S. McGehee
*Attorney, Agent, or Firm*—Clayton R. Johnson

[57] ABSTRACT

Apparatus for filling a bag that has a bag pick-up assembly movable from a pick-up position to pick up a flat folded bag from a magazine to a bag release position, a table for supporting the released bag in a generally horizontal condition, a bag opening assembly for grippingly engaging the mouth edge portions of the bag on the table and opening the bag mouth portion, the bag opening assembly including stationarily mounted lower vacuum cups on the table and vertically movable upper cups, a spout assembly for clampingly engaging an opened bag, transferring the clamped bag from a bag transfer position to a filled bag release position, discharge a weighed charge into the clamped bag, and release the filled bag, the spout assembly including spout jaws and bag holders to clamp the opened bag to the jaws, a bag transfer assembly for moving the opened bag on the table to the spout in the bag transfer position, the transfer assembly including a pair of fingers that are movable toward one another and into the bag that is held open by the bag opening assembly and then apart to support the opened bag after it is released by the bag opener assembly, and after the bag is clamped to the spout, moved out of the bag mouth, and controls for the above assemblies. While a bag on the spout is being filled, the transfer assembly is returning to a position for extending the fingers into another opened bag mouth.

In a second embodiment a piston cylinder combination and control elements are provided to shift the pick up assembly a limited amount in the event a picked up bag was longitudinally offset on the bag magazine.

34 Claims, 15 Drawing Figures

10
12
13
14
16
17
18
19
20
21
22
23
24
38
39
40
41
46
51
53
54
57
58
59
60
62
63
64
75
83
91
95
98
102
103
104
105
146
149
150
151
152
153
159
160
163
165
166
167
172
173
174
175
176
181
186
187
188
528

FIG. 7
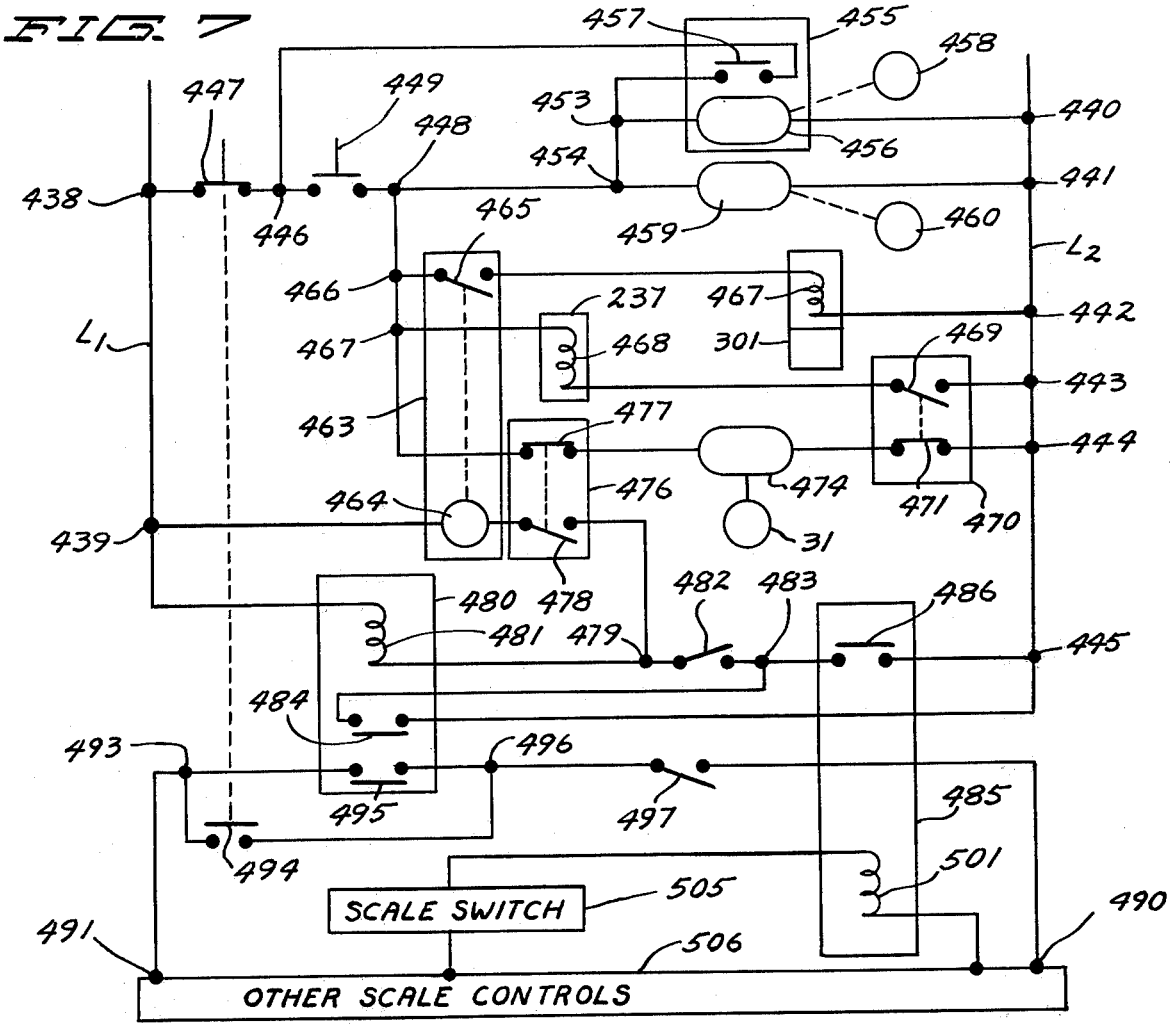
FIG. 8
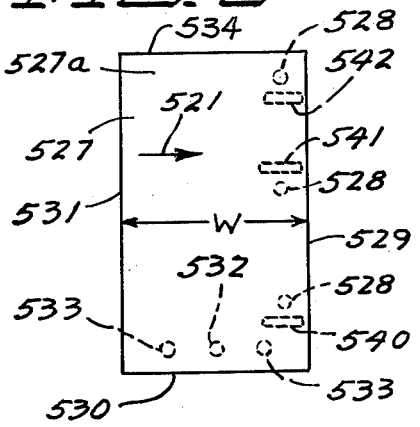
FIG. 9
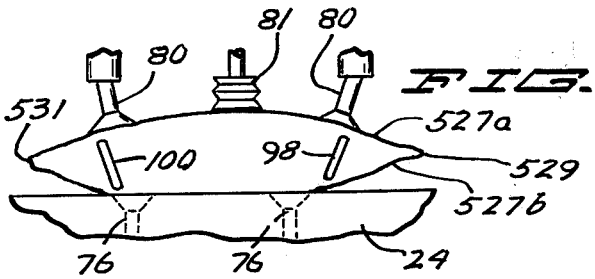
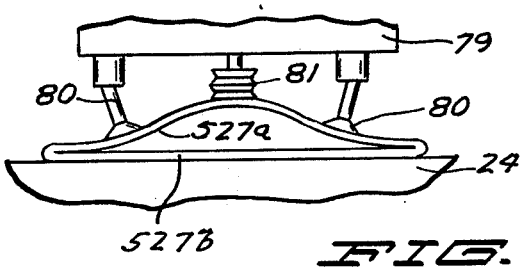
FIG. 10
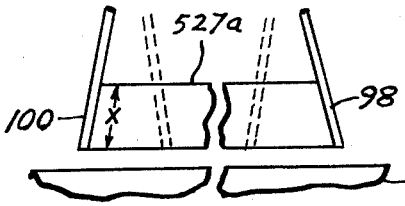
FIG. 11

BAG OPENING AND FILLING APPARATUS

BACKGROUND OF THE INVENTION

A machine for removing a folded bag from a magazine, opening the removed bag and filling the opened bag.

In U.S. Pat. No. 3,673,759 there is disclosed a machine that has a combined bag pick-up and bag mouth opening assembly for picking up a bag from a magazine, open the bag mouth portion, and transfer the bag to a spout assembly that has a fixed jaw stationarily mounted on the frame. U.S. Pat. No. 3,050,918 discloses a machine that includes pick-up cups for removing a vertical flat folded bag from a magazine, a bag opening cup for opening the bag gripped by the pick-up cups, a spout assembly for clampingly holding a bag and being movable from a bag transfer position to a filled bag discharge position, and a transfer assembly for grippingly engaging the bag held open by the bag opening and pick-up cups and transferring the bag to the spout assembly. However such prior art machines are not suitable for opening and filling most plastic bags that are presently being used. In order to provide a machine for opening and filling plastic bags, as well as bags of other materials, this invention has been made.

SUMMARY OF THE INVENTION

A machine for opening and filling bags that includes a bag pick-up assembly for moving a flat folded bag from a magazine to a table, a bag opening assembly for opening the mouth portion of the bag while the remainder of the bag is supported by the table, a spout assembly for clampingly engaging an opened bag and emptying a weighed charge into the bag, and a bag transfer assembly for engaging the opened bag on the table and transferring the bag to the spout assembly.

One of the objects of this invention is to provide new and novel means for engaging a bag having an opened bag mouth and transferring the bag to a spout assembly. Another object of the invention is to provide new and novel means for opening the bag mouth portion of a bag. A further object of the invention is to provide new and novel means for picking up a flat folded bag from a magazine and moving the bag to a position to have its bag mouth opened. An additional object of the invention is to provide new and novel means for moving one bag from a magazine to a bag mouth opening position and at the same time transferring another bag having an opened bag mouth to place it on a spout assembly.

A further object of the invention is to provide new and novel means for mounting and shifting a bag pick-up assembly a limited amount in one direction in the event a bag picked-up is offset for being properly opened by the bag opening assembly.

BRIEF DESCRIPTION OF THE DRAWINGS

FIG. 1 is a side view of the first embodiment of the apparatus of this invention with parts of the frame being broken away, the bag pick-up cups being shown in a lowered pick-up position, the bag opening cups being shown in a datum position, the bag transfer assembly being shown in a datum position in solid lines other than for the bag opening fingers being in a bag inserted position, and said fingers being shown in a datum position in dotted lines; and the spout assembly being shown in a datum bag clamped position in solid lines, and in part shown in the bag transfer position in dotted lines; said view being generally taken along the line and in the direction of the arrows 1—1 of FIG. 3;

FIG. 8 is a diagrammatic representation showing the locations that the bag pick-up cups and the upper opening cups engage a bag relative the bag mouth and side edges during the respective time interval the cups engage the bag;

FIG. 9 is generally a diagrammatic representation of the bag mouth portion of a bag as it is held in an open position by the bag opening cups with the upper cups in their elevated position;

FIG. 10 is generally a representation of a mouth portion of a bag gripped by the bag opening cups with a vacuum applied thereto and the upper cup manifold in its lowered position, the thickness of the side walls being exaggerated;

FIG. 11 is generally a diagrammatic representation of a mouth portion of an opened bag supported by the fingers in their "in-apart" position, the finger mounting rods being shown in dotted lines in their closed position, and the transversely intermediate part of the bag mouth portion not being shown.

FIG. 12 is a fragmentary side view of a portion of the structure of FIG. 2, other than it also illustrates the location of the electric eye light source and cell, and the structure for longitudinally shifting the bag pick-up assembly of the second embodiment of the invention;

Figure 2:
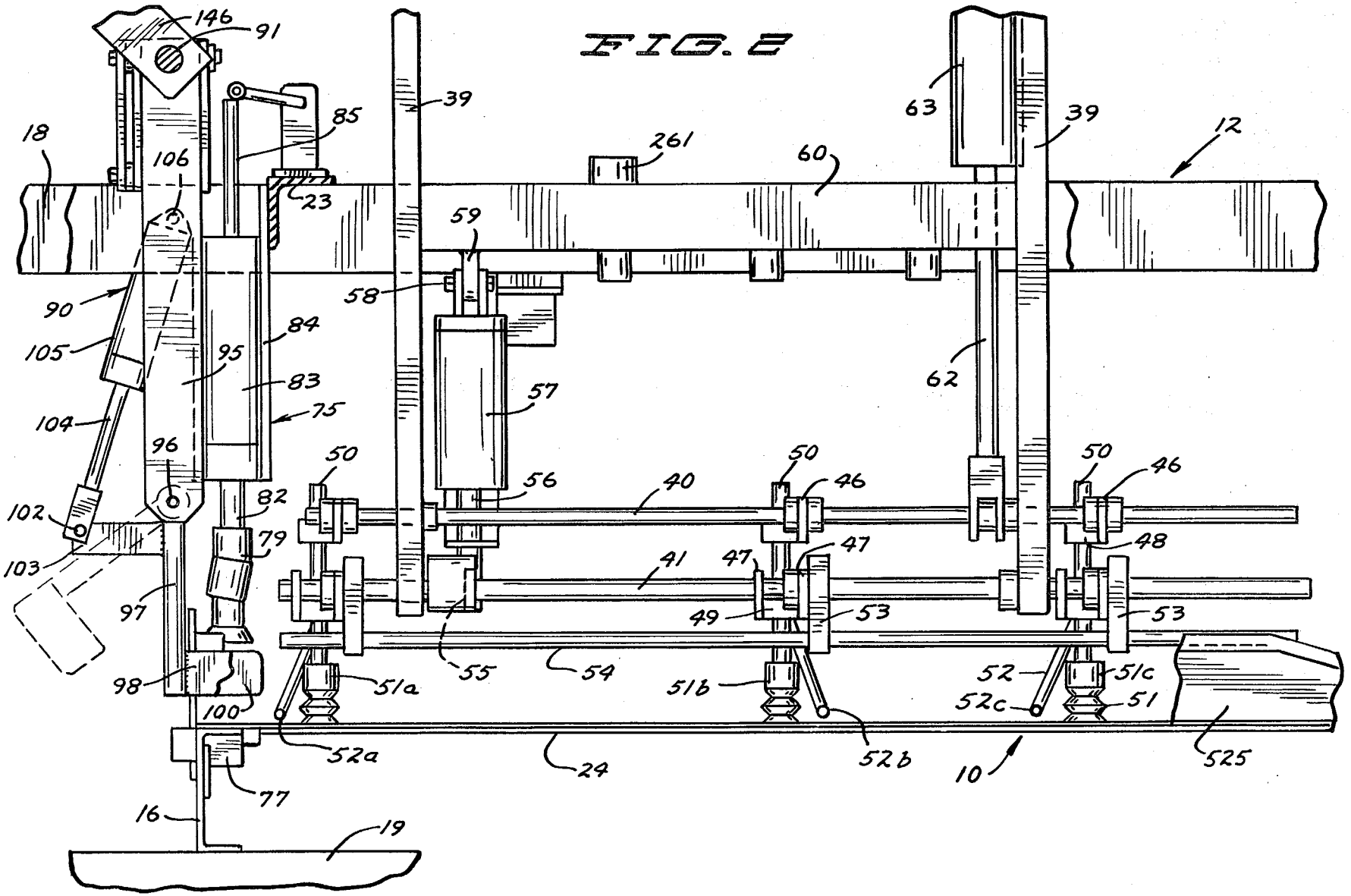
FIG. 2 is an enlarged side view of a portion of the structure of FIG. 1, portions of the frame not being shown.
Figure 3:
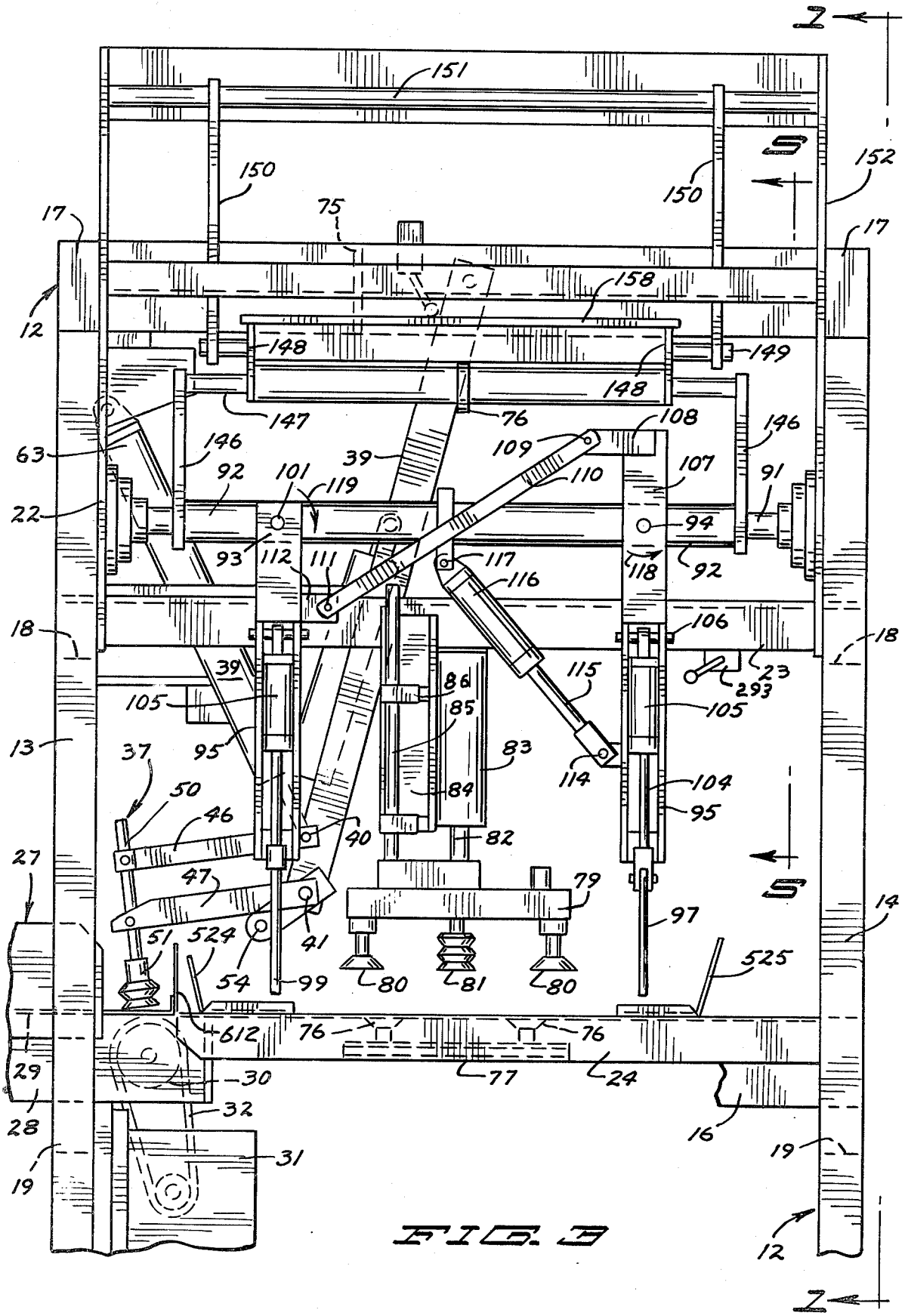
FIG. 3 is a fragmentary front view of the apparatus of FIG. 1 other than the hopper and spout are not shown, and a portion of the magazine for supplying bags to the apparatus of this invention is illustrated.

Referring now in particular to FIGS. 1–3, the apparatus of the first embodiments, generally designated 10, this invention includes the frame, generally designated 12. As viewed from FIG. 3, the frame 12 includes front and rear left-hand uprights 13, front and rear right-hand uprights 14, lower transverse frame members (not shown) extending between the front and rear uprights respectively, upper longitudinal frame members 17 that extend between the uprights 13 and 14 respectively and also extend forwardly of the respective front upright, intermediate longitudinal frame members 18 extending between the left-hand and right-hand uprights respectively, lower longitudinal frame members 19 extending between the left and right-hand uprights respectively, an upper intermediate transverse frame member 20 extending between frame members 17, an upper intermediate frame member 21 extending between frame members 17 and that is located longitudinally intermediate the front uprights and frame member 20, vertical frame members 22 extending between the respective pair frame members 17 and 18 on each side of the machine, and a transverse frame member 23 extending between the longitudinal frame members 22 and located generally vertically below frame member 21. A table (bag support) 24 has a generally horizontal top surface and is mounted by frame members 16 which in turn are mounted by frame members 19. Bag gripper vacuum cups 76 and 76 are mounted in transverse spaced relationship on the table for holding a bag dropped onto the table in a proper position to be picked up.

For conveying a plurality of flat folded bags in vertical stacked relationship to a position to be picked up by the apparatus of this invention, there is provided a magazine, generally designated 27. The magazine includes a magazine frame 28 which mounts a driven roll 30 and an idler roll (not shown) to the left of roll 30 as viewed in FIG. 3. A conveyor belt 29 is extended over said rolls whereby the upper run of the belt will support the bags in a flat folded horizontal condition in a vertical stacked relationship. Motorreducer 31 is drivenly connected by a drive connection 32 to the driven roll 30 so as to move the upper run of the conveyor belt in a direction for moving a first stack of bags into a position for having bags picked up therefrom by the apparatus of this invention, and after all of the first stack have been removed from the belt, move a second vertical stack to a position to be picked up.

Figure 4:
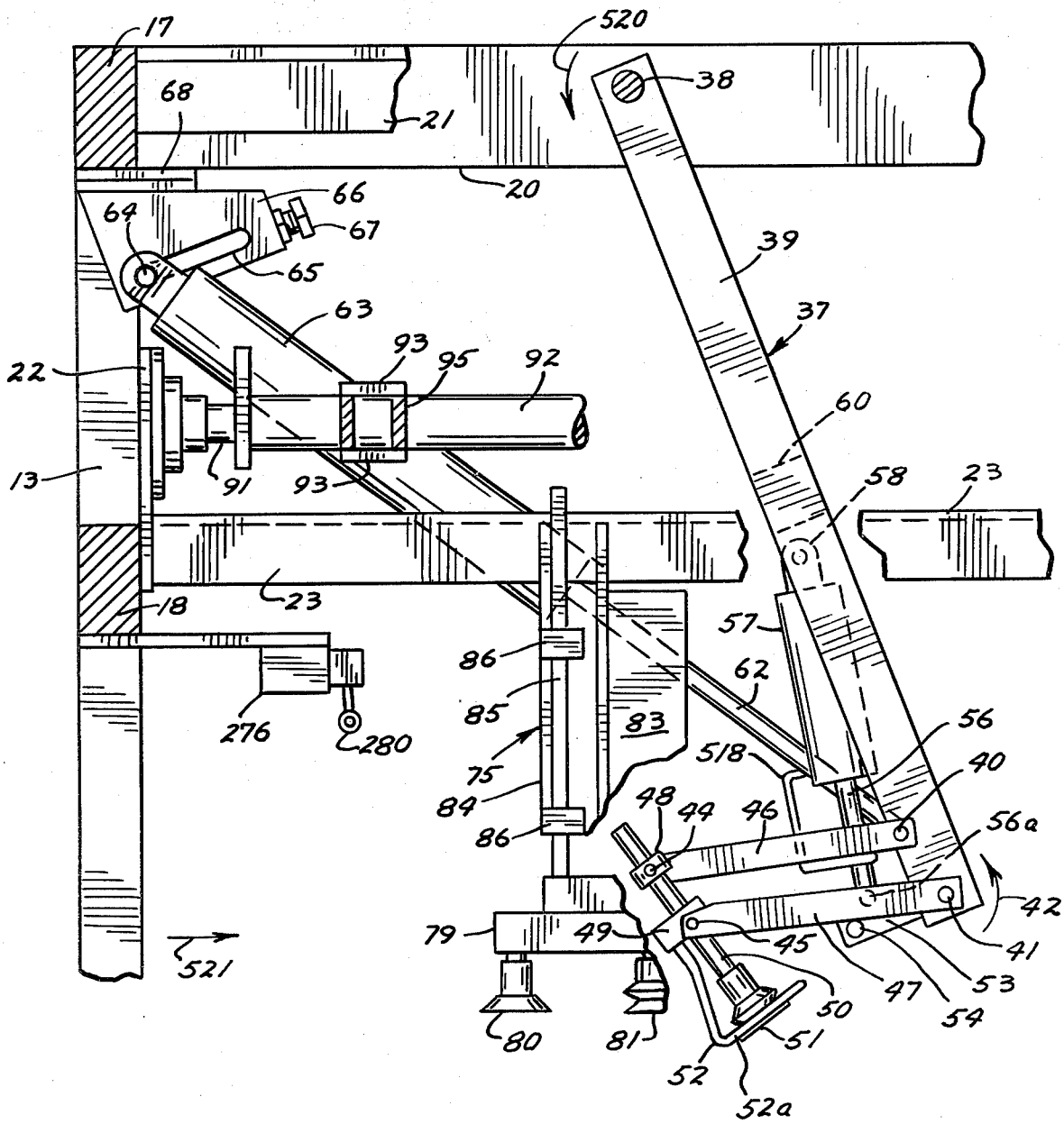
FIG. 4 is a fragmentary transverse cross-sectional view generally taken along the line and in the direction of the arrows 4—4 of FIG. 1 with various portions broken away, other than the bag pick-up assembly is shown in a picked-up bag released position.

For picking up bags one at a time from the magazine and transferring the bag to the table, there is provided a bag pick-up assembly, generally designated 37 (also see FIG. 4). The pick-up assembly includes a longitudinal shaft 38 that is rotatably mounted by frame members 20 and 21. The upper ends of a pair of longitudinally spaced swing arms 39 are secured to the shaft in depending relation thereto to rotate therewith, the lower ends of the swing arms mounting a pair of longitudinally elongated shafts 40 and 41 in spaced relationship to one another with the shaft 40 being located more closely adjacent shaft 38 than shaft 41.

Pivotally mounted on the shaft 41 are the one ends of three sets of pairs of arms 47, the opposite ends of said arms having a bracket 49 pivotally connected thereto by pivot members 45. Shaft 40 pivotally mounts the one ends of three arms 46, the opposite end of each arm having a bracket 48 pivotally connected thereto by a pivot member 44. Each bracket 49 and the adjacent bracket 48 has a rigid metal tube 50 extended therethrough to move therewith, the lower end of each tube mounting a vacuum cup 51 (cups 51*a*, 51*b*, and 51*c* respectively) that is of an accordian type such that when the lower bag gripping peripheral edge of the cup engages the bag to be picked up, said edge moves a substantial distance toward tube 50 when a vacuum is applied therethrough. Further, each bracket mounts a generally L-shaped rod 52 having a generally vertically extending portion mounted by the bracket and a lower generally horizontal leg (lower legs designated 52*a*, 52*b* and 52*c* respectively) that extends to the right of the vertical leg as viewed in FIG. 4. The lower legs are at a slightly higher elevation than the bag gripping edge of the respective cup 51 when such cup is in engagement with the bag on the stack of bags on the magazine and no vacuum is applied thereto; but that extends to a lower elevation than the bag gripping edge after a vacuum has been applied thereto and the bag gripping edge has moved more closely adjacent to bracket 49.

For moving the cups 51 relative the swing arms from a lowered bag pick-up position to an elevated position, there is provided a longitudinal rod 54 that extends beneath the arms 47 at a location more closely adjacent shaft 41 than the pivot members 45. The shaft 54 is mounted by the one end of arms 53 while the opposite ends of the arms are mounted on shaft 41 to rotate therewith. For pivoting shaft 41 and thereby arms 53, an arm 55 has one end fixed to shaft 41 while the opposite end of said arm is pivotally connected to piston rod 56 of the piston cylinder combination 56, 57 by a pivot member 56*a*. Cylinder 57 is pivotally connected by a pivot member 58 to a bracket 59 that is dependingly secured to a vacuum manifold 60, the menifold 60 being mounted on the swing arms 39 to move therewith.

To move the swing arms about the pivot axis of shaft 38 between the bag pick-up position and a bag release position, there is provided a piston cylinder combination 62, 63; said combination including a piston rod 62 that is pivotally connected to rod 40. The cylinder 63 is connected to a pivot member 64 that is extended through an elongated slot 65 in a bracket 66; there being provided an adjustment member 67 for moving pivot member 64 in the slot and retaining the pivot member in a selected adjusted position. This adjustment feature is provided to facilitate the use of this invention with different width bags. The bracket 66 is mounted by plates 68 which in turn are secured to frame member 17.

For opening the mouth portion of a bag once the bag has been deposited on the table 24, there is provided a bag opening assembly, generally designated 75. The assembly 75 includes a pair of transversely spaced lower cups 76 that extend upwardly through apertures (not shown) in the table to have their bag gripping surfaces a slight distance above the table. The cups 76 are mounted by a manifold 77 which in turn is secured to the table. For moving the top mouth edge portion of a bag that has its lower mouth edge portion gripped by lower cups 76, there is provided an upper cup subassembly that includes a transversely elongated upper manifold 79. The manifold mounts end cups 80 and an intermediate cup 81 between the end cups. The cups 80, 81 are of a construction that when no vacuum is being applied through the cups, the lower bag gripping edges thereof are at substantially the same elevation. However, the intermediate cup is of accordian type construction whereby when the cup 80,81 grip a flat folded bag and have a vacuum applied thereto, the bag gripping edge of the intermediate cup moves substantially closer to the manifold 79 than the bag gripping edges of the end cups. For vertically moving the manifold 79 between a lower bag gripping position and an elevated position, the manifold is connected to the piston rod 82 of a piston cylinder combination 82, 83. The cylinder is mounted on a cylinder mount 84 which in turn is dependingly secured to frame member 23. The lower end of a guide rod 85 is attached to the upper manifold 79, the guide rod being slidably extending through guide rod brackets 86 which in turn are attached to the mount 84.

Figure 5:
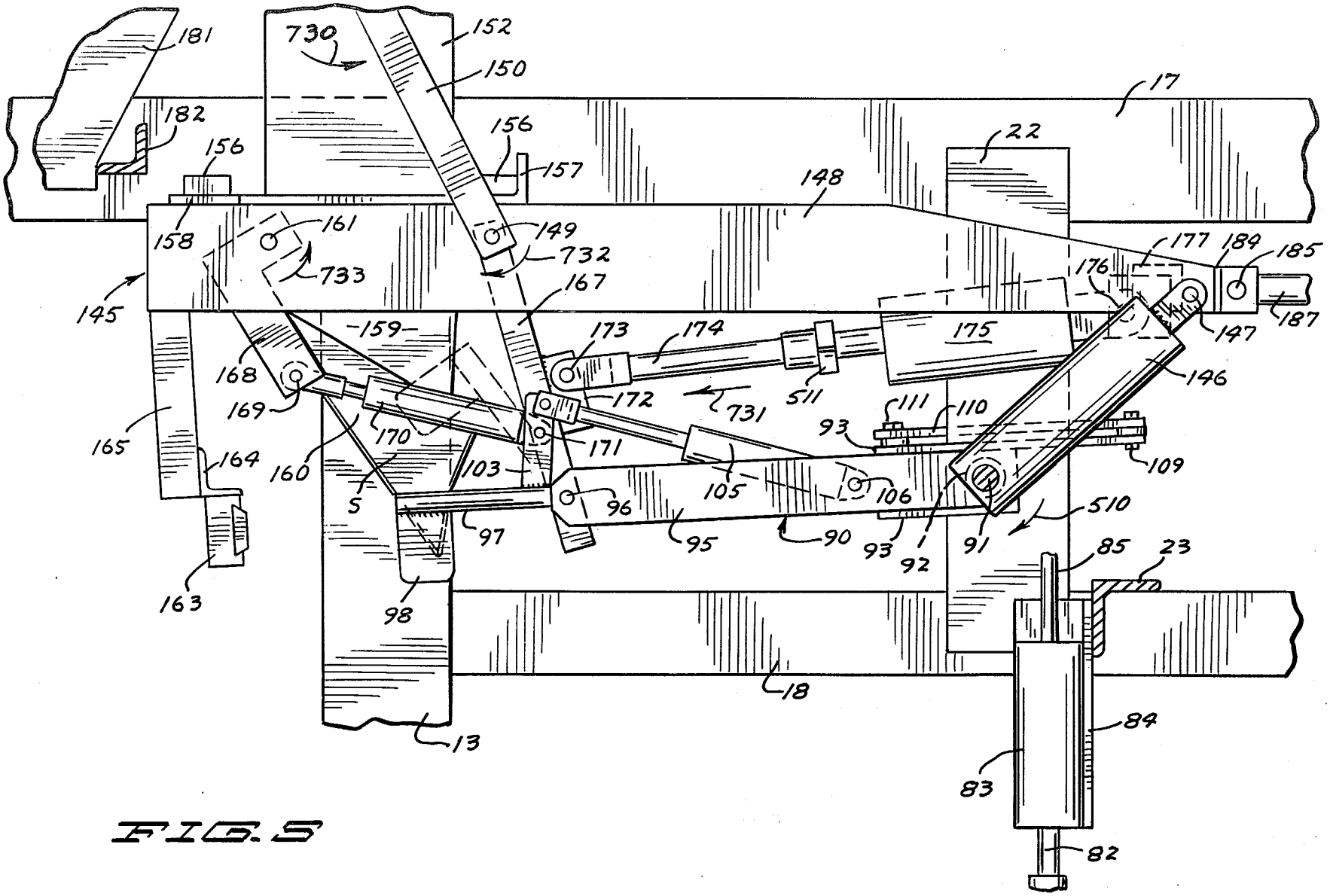
FIG. 5 is the longitudinal view of the spout assembly and the bag transfer assembly in bag transfer positions, said view being generally taken along the line and in the direction of arrow 5—5 of FIG. 3. This view also shows the bag opening fingers in a retracted position in dotted lines.

For transferring the opened bag that is being grippingly engaged by the vacuum cups 76, 80 and 81 from the table to the spout S that is used for filling the bag, there is provided a bag transfer assembly, generally designated 90 (see FIGS. 2, 3 and 5). The assembly 90 includes a transverse shaft 91 mounted by plates 22 and a tube 92 rotatably mounted on the shaft. At each end of the tube 92 there is provided a pair of plates 93 that are pivotally connected at 94, 101 respectively to the tube 92 to rotate therewith and to pivot about axes that are perpendicular to the axis of pivotal movement of the tube. To each set of plates 93 there is secured a pair of spaced plates 95 that extend radially away from the tube 92, radial outer ends of each set of plates 95 mounting a finger pivot 96. The one end of an arm 97 is mounted by one of the pivots 96 while the other pivot 96 mounts a corresponding arm 99. The arms 97 and 99 respectively mount a wing (finger) 98 and 100, the wings being elongated in a direction perpendicular to the direction of elongation of the arms, and extend rearwardly relative the arms when the arms extend vertically.

To move the wings (about a transverse axis when both sets of plates 95 are parallel) between a retracted position and a position extending into the bag mouth of a bag held open by the vacuum cups, to each wing arm there is attached an operator arm 103. Each operator arm is pivotally connected at 102 to a piston rod of a piston cylinder combination 104, 105. The cylinder of each combination is pivotally connected at 106 to the respective set of plates 95, the pivot axis of pivot 106 being parallel to and intermediate the pivot 96 and shaft 91.

To the right-hand front plate 93 there is attached a plate 107 that extends away therefrom in a direction opposite of plates 95, the end of plate of 107 opposite plates 93 mounting a plate 108 to extend transversely to the left as viewed in FIG. 3. One end of a link 110 is pivotally connected at 109 to plate 108 while the opposite end of the link is pivotally connected at 111 to a plate 112. Plate 112 is attached to a plate 93 that is pivotally connected at 101 to the tube 92. The pivot axis of pivot members 101, 111, 109 and 94 are parallel to one another; while when the plates 95 extend vertically downwardly of the shaft, pivot member 111 is located at a lower elevation than the plane of the pivot axis of pivots 94, 101 and pivot member 109 is located above said plane. Further, pivot members 109, 111 are located horizontally between pivot members 94, 101. Accordingly, when wing arm 99 is pivoted in the direction of the arrow 119 above pivot 101, wing arm 97 is pivoted in the direction of arrow 118 about pivot member 94 so that the wings are moved to positions transversely more remote from one another. For pivoting the wings in the aforementioned manner, there is provided a piston cylinder combination 115, 116 that has a piston rod 115 pivotally connected at 114 to one of the plates 95 of the set of plates to which the wing arm 97 is pivotally connected. The cylinder 116 is pivotally connected at 117 to the tube 92 so that the cylinder will rotate with the tube and can pivot relative thereto; the pivot axes 114, 117 being parallel to the pivot axis of pivot 101.

For pivoting the tube 92 between a position that the wings 98, 100 are adjacent the table and an elevated position to place an open bag on closed spout jaws 159, 160, the one ends of arms 146 are welded to tube 92. The opposite ends of said arms pivotally mount shaft 147, shaft 147 being mounted by rear ends of longitudinally elongated arms 148 of the spout assembly, generally designated 145. The forward intermediate portions of arms 148 mount a shaft 149, shaft 149 being pivotally attached to the one ends of arms 150. The opposite ends of arms 150 are mounted by a shaft 151 which in turn is mounted by frame members 152 that are secured to frame members 17 to extend thereabove.

A fixed jaw 159 of the spout S is secured to jaw mounting member 157, 158 to depend therefrom, the jaw mounting members being mounted by arms 148. The spout also includes a movable jaw 160 that is mounted by jaw mounts 168, the jaw mounts 168 in turn being pivotally attached by pivot members 161 to the forward parts of arms 148. The movable jaw 160 is movable between a closed position, and an open position abutting against a bag clamp (bag holder) 163 for retaining the upper edge portion of one side wall of a bag therebetween. The bag clamp 163 is mounted by an angle iron 164 which in turn is mounted by angle irons 165 that are attached to the forward ends of arms 148 to depend therefrom. The second bag clamp (bag holder) 166 is mounted by angle irons 167 which in turn are pivotally mounted by shaft 149. A link 170 has one end pivotally connected at 169 to the movable jaw mounts 168 and an opposite end pivotally connected at 171 to the angle irons 167 whereby as bag holder 166 is moved to clamp one side wall of a bag against the fixed jaw 159, the movable jaw 160 is moved to clamp the opposite side wall against the bag holder 163. In order to move the angle irons 167 between a bag clamping position and a non-clamping position, a piston rod 174 of the piston cylinder combination 174, 175 is pivotally connected at 173 to a bar 172 that in turn is attached to angle irons 167. The cylinder 175 is pivotally connected at 176 to an angle iron 177 that extends between and is secured to the rear portion of plates 148.

For moving the spout between a position that it is beneath the hopper scale 181 and a position substantially rearwardly thereof, a transverse member 184 is fixedly attached to the rear ends of plates 148. Member 184 is pivotally connected at 185 to the piston rod 187 of the piston cylinder combination 186, 187. The cylinder 186 is pivotally connected at 188 to the transverse frame member 20.

Transverse frame members 182 are secured to frame members 17, and to the lower end portion of scale hopper 181 for mounting the scale hopper. Resilient mounts 156 are mounted on the spout mount 157, 158 for abutting against the frame members 182 when the spout is moved beneath the hopper.

Figure 6:
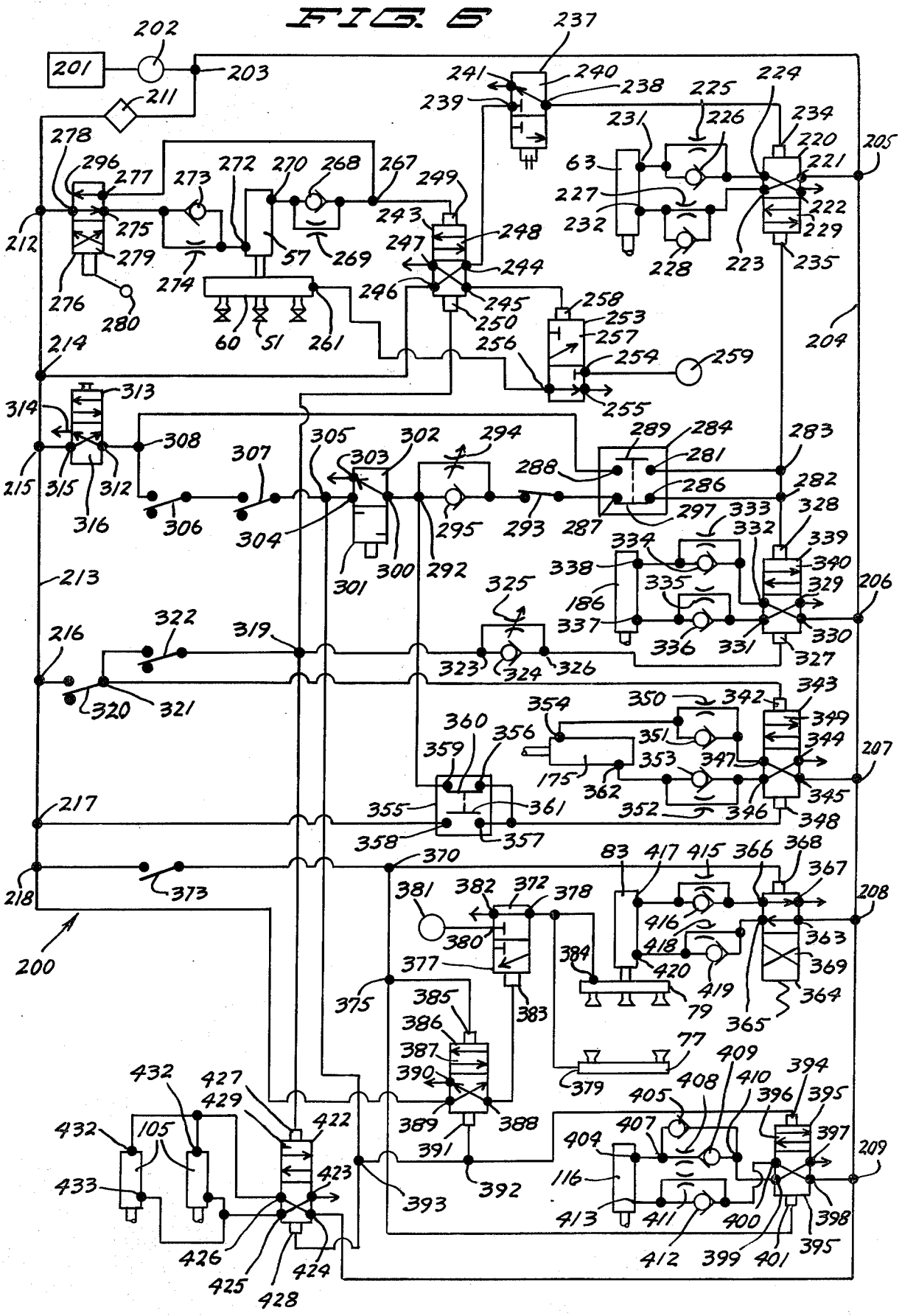
FIG. 6 is a schematic showing of the air control circuitry and components of the first embodiment of the apparatus of this invention.
Figure 18:
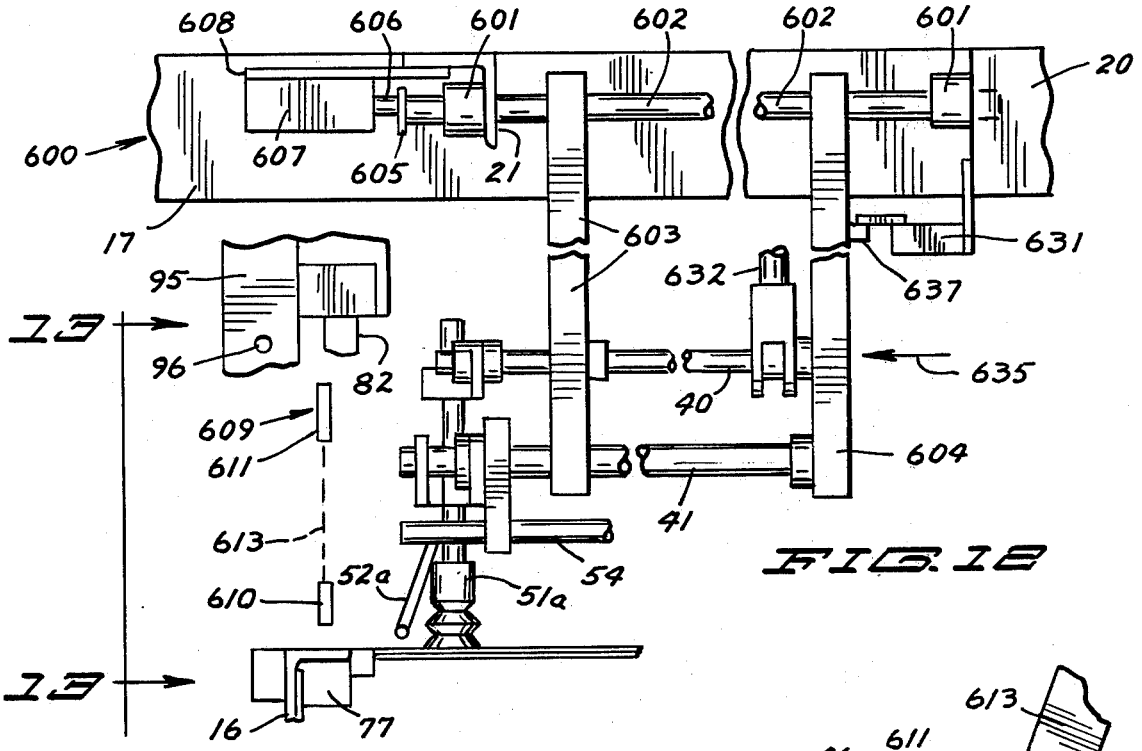

Referring now to FIG. 6, the pneumatic controls and control components, generally designated 200, include a source of air under pressure 201 that is connected through a shut-off valve 202 to junction 203. Air line 204 is connected to junction 203 and has junctions 205–209 thereon. Further a filter 211 is fluidly connected between junctions 203 and 212, an air line 213 being connected to junction 212 and having junctions 214–218 thereon.

A pneumatic valve 220 for controlling the operation of the swing arm cylinder 63 has exhaust port 222, a second port 223, a third port 224, and a fourth port 221 that is connected to junction 205. Further valve 220 has a "return" control port 234 that when air under pressure is applied thereto, valve member 229 is moved to fluidly connect port 221 to port 223, and fluidly connect port 224 to the exhaust port; and a "swing" control port 235 that when fluid under pressure is applied thereto, valve member 229 is moved to fluidly connect port 224 to port 221; and fluidly connect port 223 to the exhaust port. A flow restrictor 225 and a check valve 226 are connected in parallel across port 224 and port 231 of cylinder 63, the check valve preventing the flow of fluid therethrough from port 231 to port 224. A flow restrictor 227 and a check valve 228 are connected in parallel across port 223 and port 232 of cylinder 63, the check valve preventing the flow of fluid therethrough from port 232 to port 223.

Port 234 is fluidly connected to a first port 238 of the bag in place solenoid air valve 237, valve 237 having a second port 239, an exhaust port 241, and a valve member 240 that when the valve is energized, fluidly connects port 238 to port 239, and upon being deenergized resiliently returns to block fluid flow from port 238 to port 239 and connects port 238 to port 241.

Port 239 is fluidly connected to a first port 244 of valve 243, valve 243 also having a second port 245, a third port 246, exhaust port 247, a valve member 248 that when fluid under pressure is applied to the "on" control port 249, moves to fluidly connect the exhaust port 247 to port 244 and fluidly connect port 245 to port 246; and an "off" control port 250 that when fluid under pressure is applied therethrough moves to fluidly connect port 244 to port 246, and fluidly connect port 245 to port 247. Port 245 is fluidly connected to the control port 258 of vacuum control valve 253, valve 253 having a first port 254 that is fluidly connected to a vacuum pump 259, an exhaust port 255, a third port 256, and a valve member 257 that when air under pressure is applied at port 258, moves to fluidly connect port 256 to port 254, but upon the discontinuance of air under pressure to port 258, is resiliently moved to fluidly connect port 256 to port 255. Port 256 is fluidly connected to the inlet port 261 of the bag pick-up manifold 60. Control port 249 is fluidly connected to junction 267 which in turn is fluidly connected to a first port 277 of pneumatic switch 276. Connected in parallel across junction 267 and port 270 of the bag pick-up cylinder 57 are a check valve 268 and a flow restrictor 269. The check valve prevents fluid flow therethrough between port 270 and junction 267. Cylinder 57 also has a port 272. Check valve 273 and a flow restrictor 274 are connected in parallel across port 272 and a port 275 of a pneumatic switch 276, check valve 273 preventing fluid flow therethrough from port 272 to port 275. Switch 276 also includes a port 278 that is connected to junction 212, an exhaust port 296, a valve member 279, and an operator 280 that upon being engaged by one of the swing arms moves the valve member to fluidly connect port 278 to port 277 and port 296 to port 275, and is resiliently returned after the swing arm moves out of engagement with the operator, to fluidly connect port 278 to port 275, and fluidly connect port 277 to port 296.

A pneumatic start switch 284 has a first port 281 connected to junction 283, a second port 286 connected to junction 282, a third port 287, a fourth port 288 connected to junction 308, and switch members 289, 297 that respectively in being moved to a start position fluidly connects port 288 to port 281, and break a fluid connecton between port 286 and port 287; and in being moved to a "run" position fluidly connects port 286 to port 287, and breaks a fluid connection from port 281 to port 288. The switch is resiliently retained in a run position. A bag on fingers switch 293 is connected in series with a combination of a check valve 295 and a timing flow restrictor 294 across port 287 and junction 292, the flow restrictor and check valve being connected in parallel to one another. The check valve prevents fluid flow therethrough from junction 292 toward port 287. Switch 293 is resiliently retained in a closed condition. A bag on un-clamp solenoid operated air valve 301 has a first port 300 connected to junction 292, a second port 304, an exhaust port 303, and a valve member 302 that when the valve is energized, fluidly connects port 300 to port 304 and when deenergized fluidly connects port 300 to port 303. Connected in series across junction 308 and junction 305 are a bag "opener-up" limit switch 306 and a bag transfer off-limit switch 307. Switch 306 is closed by the guide rod 85 moving to its up position and resiliently opens when the guide rod moves down, while switch 307 is closed by a cam (not shown) on tube 92 when the tube has moved so that plates 95 extend generally vertically downwardly, and when 92 is rotated from such position is resiliently returned to its open position.

A pneumatic on-off switch 313 has a first port 312 connected to junction 308, a second port 315 connected to junction 215, an exhaust port 314 and a valve member 316 that in an off position fluidly connects port 312 to port 314, and in an on position fluidly connects port 312 to port 315. A limit switch 320 is connected across junctions 216, 321, the limit switch being closed by a cam (not shown) on tube 92 only when the transfer assembly is in its position for transferring a bag onto the spout. A "spout clamped" limit switch 322 that is closed by an operator on the piston rod 174 moving to a bag clamping position is connected across junctions 321, 319; switch 322 being mounted by arms 148 to move therewith. An adjustable flow restrictor 325 and a check valve 324 are connected in parallel across junction 323 and "return" port 327 of valve 339, the check valve preventing fluid flow therethrough from junction 323 toward port 327. Junction 319 is connected to junction 323. Valve 339, which controls the operation of the bag transfer cylinder 186, has an exhaust port 329, a port 330 connected to junction 206, a port 331, a port 332, a valve member 340, a "return" port 327, and a "up to spout" control port 328. When fluid under pressure is applied to port 328, the valve member 340 moves to fluidly connect port 331 to port 330, and fluidly connect port 332 to port 329; whereas, when fluid under pressure is applied to "return" port 327, the valve member moves to fluidly connect port 331 to port 329, and fluidly connect port 330 to port 332. A flow restrictor 333 and a check valve 334 are connected in parallel across port 332 and port 338 of the transfer cylinder 186, the check valve preventing fluid flow therethrough from port 338 to port 332. A flow restrictor 335 and a check valve 336 are connected in parallel across port 331 and a port 337 on cylinder 186, the check valve preventing fluid flow therethrough from port 337 toward port 331. The valve 343 for controlling the operation of the bag spout clamp cylinder 175 includes a "clamp" control port 342, an exhaust port 344, a port 345 that is connected to junction 207, an "unclamp" control port 348, a port 346, a port 347, and a valve member 349 that when fluid under pressure is applied to port 348 fluidly connects port 346 to port 344, and fluidly connects port 345 to port 347. When fluid under pressure is applied to port 342, the valve member fluidly connects port 347 to port 344, and fluidly connects port 346 to port 345. Port 348 is connected to ports 356, 357 of a manually operated control switch 355, switch 355 having a port 358 connected to junction 217, a port 359 connected to junction 292, and tandem connected switch members 360, 361. The switch is resiliently retained in a first position that switch member 360 fluidly connects port 356 to port 359 and switch member 361 does not fluidly connect ports 357, 358; while in the second position switch member 361 fluidly connects port 357 to port 358 and switch member 360 does not fluidly connect port 356 to port 359.

A bag mouth opening control valve 364 has a first port 363 connected to junction 208, a second port 365, a third port 366, an exhaust port 367, a "down" control port 368, and a valve member 369 that is resiliently retained in a position to fluidly connect port 366 to port 367, and fluidly connect port 363 to port 365. When fluid under pressure is applied through port 368 and as long as fluid under pressure is applied therethrough, valve member 369 fluidly connects port 365 to port 367, and fluidly connects port 363 to port 366. Control port 368 is connected to a junction 370, a limit switch 373 being connected across junctions 218, 370. A flow restrictor 415 and a check valve 416 are connected in parallel across port 366 and port 417 of the bag mouth opening cylinder 83, the check valve preventing fluid flow therethrough from port 417 to port 366. A flow restrictor 418 and a check valve 419 are connected in parallel across port 365 and port 420 of cylinder 83, the check valve preventing flow therethrough from port 420 to port 365.

A vacuum control valve 377 has a port 378 that is fluidly connected to each of port 384 of manifold 79 and port 379 of manifold 77, a control port 383 connected to port 388 of valve 386, a port 380 connected to vacuum pump 381, an exhaust port 382, and a valve member 372. When fluid under pressure is applied to, and as long as it is applied to, port 383, the valve member moves to fluidly connect port 378 to port 380; but otherwise is resiliently retained in a position to connect port 378 to port 382.

Control valve 386 has an "off" control port 391 that is connected to junction 392, a port 389 that is connected to junction 218, an exhaust port 390, an "on" control port 385, and a valve member 387 that when fluid under pressure is applied at port 385 fluidly connects port 389 to port 388, and when fluid under pressure is applied to port 391, fluidly connects port 388 to port 390 and block fluid flow from port 389 through the valve. Port 385 is connected to junction 375 which in turn is connected to junction 370.

Junction 392 is connected to junction 393 and to the "apart" control port 394 of the finger apart-closed control valve 395. Valve 395 includes an exhaust port 397, a port 398 connected to junction 209, a "closed" control port 401, a port 399, a port 400, and a valve member 396 that when fluid under pressure is applied at port 394 fluidly connects port 400 to port 397, and fluidly connects port 399 to port 398; and when fluid under pressure is applied at port 401, fluidly connects port 399 to the exhaust port, and fluidly connects port 398 to port 400. A variable pressure reducing valve 405 is connected across junctions 407, 410, junction 410 being connected to port 399. The flow restrictor 408 and the check valve 409 are connected in series across junctions 407, 410. Valve 405 is set to control the pressure of fluid applied at port 404, i.e. provided a reduced pressure at the port 404. Check valve 409 prevents fluid flow therethrough from junction 410 toward junction 407. Junction 407 is connected to port 404 of cylinder 116. A flow restrictor 411 and a check valve 412 are connected in parallel across port 400 and port 413 of cylinder 116, the check valve preventing fluid flow therethrough from port 413 toward port 400.

A finger in-out control valve 422 has an exhaust port 423, a port 424 that is connected to junction 209, an "in" control port 428, a port 425 that is connected to each of ports 433 of the cylinders 105, a port 426 that is connected to each of ports 432 of cylinders 105, an "out" control port 427 that is connected to the junction 319, and a valve member 429 that when fluid under pressure is applied at port 427, connects port 426 to port 423, and connects port 425 to port 424; and when fluid under pressure is applied at port 428 fluidly connects port 425 to the exhaust port 423, and fluidly connects port 424 to port 426. Port 428 is connected to junction 393 which in turn is connected to each of junctions 305, 392.

Each of valves 220, 243, 339, 364, 395 386, 343 and 422 is of a type that when air under pressure is applied to one control port, its valve member moves as indicated, and remains in the position it moved to until fluid under pressure is applied to the other control port.

Figure 7:
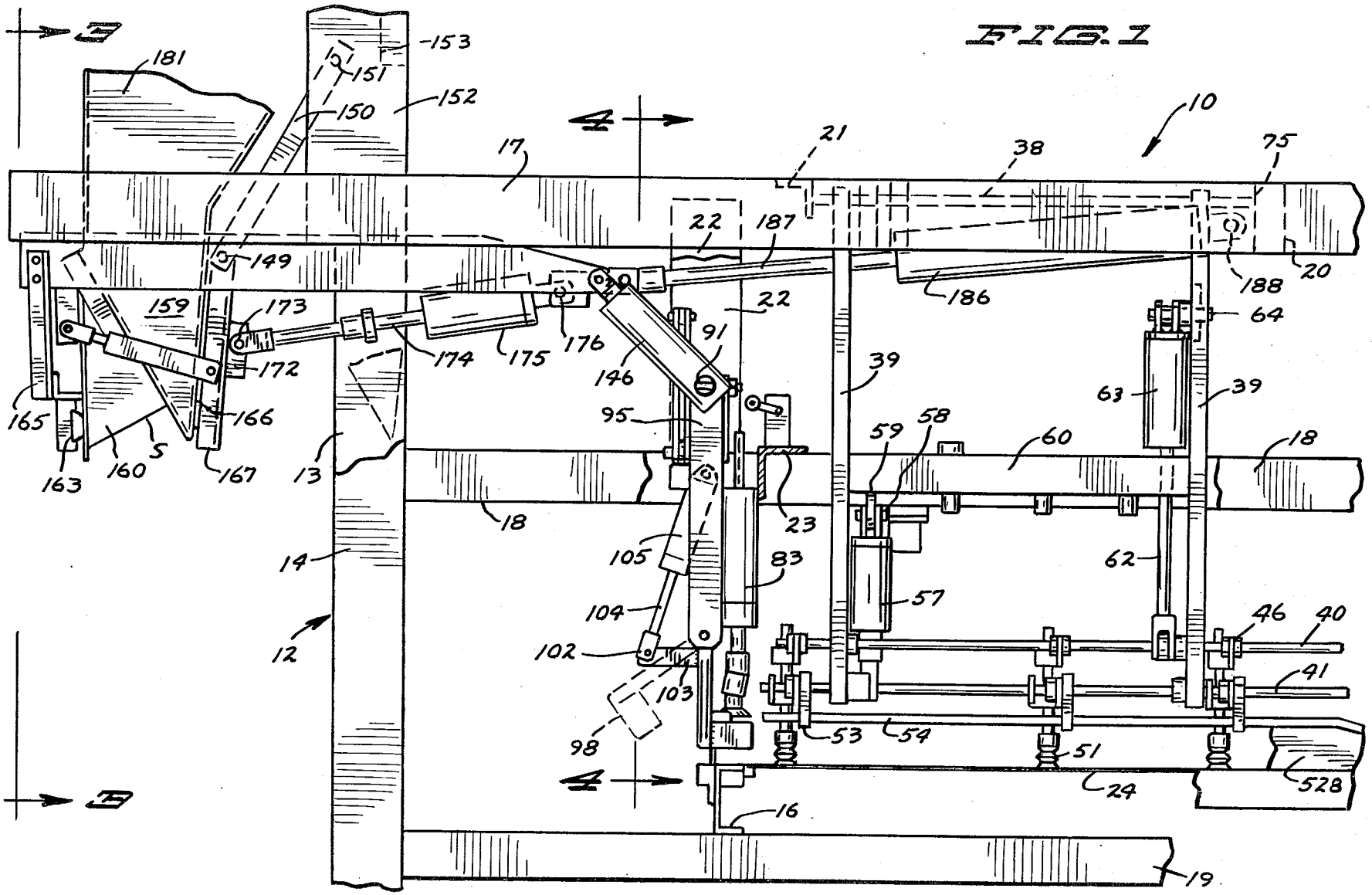
FIG. 7 is a schematic showing of the electrical circuitry of the first embodiment of the apparatus of this invention together with portions of the control circuitry of the hopper scale with which the apparatus of this invention may be used.

Referring now to FIG. 7, the electric control circuitry includes a main line $L1$ having junctions 438, 439 thereon, and a main line $L2$ having junctions 440-445 thereon. An emergency stop switch has a switch member 447 resiliently retained in a closed position to electrically connect junctions 438, 446, a start switch 449 that is resiliently retained in an open condition being connected across junctions 446, 448. Junction 448 is connected to junctions 454, 453, 466, and 467.

The switch member 457 of vacuum pump relay 455 is connected across junctions 446, 453, the relay including a solenoid coil 456 that is connected across junction 453, 440. When coil 456 is energized, switch 457 moves to a closed position. Coil 456 through conventional electric circuitry (not shown) controls the energization of vacuum pump motor 458 so that when and as long as the coil is energized, electric power is provided to energize motor 458. A second vacuum pump relay 459 is connected across junctions 454, 441 and when and as long as it is energized, through conventional electric circuitry (not shown) energizes vacuum pump motor 460. Motor 458 drives pump 259 and motor 460 drives pump 381.

Solenoid coil 467 of control valve 301 and switch member 465 of time delay relay 463 are connected in series across junctions 442, 466. Solenoid coil 468 of valve 237 and switch member 469 of the stack in place on the magazine limit switch 470 are connected in series across junctions 467, 443. Switch member 477 of swing arm at pick-up limit switch 476, a solenoid coil of magazine relay of 474, and a second switch member of 471 of limit switch 470 are connected in series across junctions 467, 444. When and as long as the solenoid coil of relay 474 is energized, the magazine motor 31 is energized through conventional electric circuitry (not shown). Switch members 471, 469 are connected in tandem so that when switch member 469 is open, switch member 471 is closed, and when switch member 471 is open, switch member 469 is closed.

Switch member 478 of switch 476 and the solenoid coil 464 of the time delay relay 463 are connected in series across junctions 439, 479. Switch members 478, 477 are connected in tandem so that when switch member 477 is closed, switch member 478 is open, and when switch member 478 is closed, switch member 477 is open. As to the time delay relay, upon energization of coil 464, switch member 465 is open and is retained in an open position until the end of the time cycle, thence is moved to a closed position for a short time, and then opens.

The solenoid coil 481 of the dump relay 480 is connected across junctions 439, 479, dump limit switch 482 being connected across junctions 479, 483. A switch member 484 of relay 480 is connected across junction 483, 445, switch member 484 being moved to a closed position by the energization of coil 481. The switch member 486 of scale relay 485 is connected across junctions 483, 445.

The scale switch 505 of the scale hopper and solenoid coil 501 of relay 485 are connected in series with one another and across other conventional scale controls 506. Scale switch 505 is of a type that closes when the scale has come to a predetermined weight, and that coil 501 is energized after switch 505 is energized. Coil 501 in being energized moves switch member 486 to a closed position.

A junction 491 on scale controls 506 is connected to junction 493, switch member 495 of relay 480 being connected across junctions 493, 496. When relay coil 481 is energized, switch member 495 is moved to a closed position. Also connected across junctions 493, 496 is a switch member 494 of the emergency stop switch, switch member 494 normally being in an open position, but when the emergency stop switch is depressed, is moved to a closed position at the same time switch member 447 is moved to an open position. Connected across junction 496 and a junction 490 on the scale controls 506 is a limit switch 497 that is resiliently retained in an open condition, but that is moved to a closed position by a bag that is clamped on the spout. In order for the scale hopper to dump a charge, switch 497 has to be closed and either switch member 494 or 495 has to be closed.

For purposes of describing the operation of the apparatus of this invention, at the time of startup, it will be assumed that the swing arms are midway between their bag pick-up and bag release position, that no bag is being clamped to the spout, and that a stack of bags on the magazine is abutting against the bag in place switch 470. With the stack of bags in place, switch member 469 is retained in a closed position, and switch member 471 is retained in an open condition to prevent the magazine motor relay 474 being energized. Since the stop switch is resiliently retained in a position that switch member 494 is open, and switch member 447 is closed, power is available at junction 446. Now electrical switch 449 is closed for sufficient period of time to energize relay coil 456 which moves switch member 457 to complete a hold in circuit, and through conventional circuitry (not shown) energizes vacuum pump motor 458. Further, at the same time, relay 459 is energized to energize vacuum pump motor 460; and the solenoid coild of the bag in place control valve 237 is energized to fluidly connect port 238 to port 239.

Switch member 332 is open since the bag clamp cylinder piston rod 174 is in its retracted position.

Upon opening pneumatic valve 202, air under pressure is applied to junction 203; and since neither swing arm is abutting against operator 280, fluid under pressure is applied through valve 276 to the lower end of the pick-up cylinder 57 to move rod 54 for elevating the bag pick-up cups. Switch 313 is manually operated to an on position to apply fluid under pressure from port 315 to port 312 until such time as the switch is manually operated to its off position.

Now switch 284, which is resiliently retained in the position shown in FIG. 6, is pushed to fluidly connect port 288 to port 281. This applies air under pressure to the swing control port 235, and thus valve member 229 moves to apply air under pressure to port 231 of the swing arm cylinder 63. This results in the swing arms pivoting in the direction of arrow 520 (FIG. 4) to a bag release position. At the same time, air under pressure is applied to up control port 328 of the bag transfer control valve to move the valve member 340 for applying air under pressure to port 337 of the bag transfer cylinder 186 to retract piston rod 187 and pivot tube 92 about shaft 91 in a direction of the arrow 510 (see FIG. 5). After valve members 229, 340 have moved as indicated in this paragraph, the manual pressure on switch 284 is released whereupon it returns to the position shown in FIG. 6.

As the tube 92 is pivoted in the direction of arrow 510, the transfer arms 95 are moved from their generally vertical position as viewed from the side (see FIG. 1) to their generally horizontal bag transfer position (see FIG. 5). Upon tube 92 pivoting to its generally horizontal bag transfer position (maximum amount in the direction of arrow 510), a cam (not shown) on tube 92 closes limit switch 320 for applying air under pressure at the clamp control port 342 of valve 343 for moving the valve member 349 to apply air under pressure to cylinder 175 at port 362. This results in the piston rod 174 being extended and the operator 511 thereon moves the spout clamp limit switch 322 to a closed position for applying air under pressure to the return port 327 of the bag transfer valve 339. However there is a delay in the shifting of valve member 340 due to the provision of the timing restrictor 325. That is, the timed delay restrictor 325 is set so air under pressure does not build up sufficiently at port 327 for shifting the valve member until a sufficient time has elapsed for the bag being clamped to the spout, and the fingers moving to their out position as will be subsequently described. The closing of switch 322 also will result in air under pressure being applied to the off port 250 of valve 243 whereby its valve member is moved to fluidly connect port 246 to port 244. As a result air under pressure is applied to a return port 234 of the swing arm control valve for moving its valve member to fluidly connect port 221 to port 223. This retracts the piston rod 62 and thereby moves the swing arms toward the bag pick-up position.

When the swing arms return to the bag pick-up position, one of the swing arms engages swing arm at pick-up limit switch 476 to open switch member 477 to prevent the magazine motor 31 being energized and to close switch member 478 to energize the time delay relay coil 464 upon the closing of the dump limit switch 482 and either switch member 484 of relay 480 or switch member 486 of relay 485.

When air under pressure at the return port 327 of the transfer control valve is built up sufficiently to shift valve member 340, air under pressure is applied to cylinder 186 which results in tube 92 rotating in a direction opposite arrow 510 toward the transfer arm bag receiving position, and thereupon switch 320 moves to an open position. As tube 92 is rotated in the direction opposite arrow 510, a cam thereon (not shown) closes limit switch 373 so that air is applied to the down port 368 of valve 364 for moving valve member 369 to conduct fluid under pressure to port 417 of cylinder 83. This moves the manifold 79 downwardly, and the guide rod 85 out of engagement with limit switch 306 so that switch 306 moves to an open position to prevent fluid under pressure being applied to swing port 235 when the bag opening manifold is out of its up position. Thereafter the last mentioned cam moves off limit switch 373 so that switch 373 returns to its open position. Upon the switch 373 opening, valve member 369 is resiliently returned to apply fluid under pressure to the port 420 of cylinder 83 for elevating the upper bag opening cups and the guide rod 85. Upon cups 80, 81 being moved to their bag open position, the guide rod moves switch member 306 to a closed position.

Upon the transfer tube being rotated to its bag receiving position (vertical position of arms 95 as viewed from the side), a cam on tube 92 (not shown) engages switch 307 for closing said switch. As soon as the time delay relay has timed out, it moves its switch member 465 to energize the solenoid coil of valve 301 to fluidly connect port 304 to port 300. Since at this time switch member 293 is closed, this completes an air circuit from junction 308 through switches 306, 307, 293 and valve 301 to junction 282. The timing restrictor 294 is set to prevent premature application of fluid under pressure at junction 282.

Prior to the time transfer tube 92 has returned arms 95 to their bag receiving position, the swing arms have pivoted to their bag pick-up position and operate the swing arm at pick-up switch 476 as above indicated. Additionally at the time the swing arms are moved to their pick-up position, a bracket 518 that is attached to piston rod 56 to move therewith engages operator 280 of control valve 276 for moving the valve member 279 to a position to fluidly connect port 278 to port 277. As a result, air under pressure is applied to port 270 of the pick-up cylinder so that rod 54 is pivoted in a direction of arrow 42 about pivot 42 to permit arms 46, 47 pivoting about pivots 40, 41 under gravity to a position that cups 51 abut against the top bag of the stack at the bag pick-up position on the magazine. Rod 54 is pivoted so that the pick-up cups can move down under gravity to a position for picking-up only a single bag on the magazine conveyor. Further at the time air under pressure is applied to port 270, air under pressure is applied to "on" port 249 so that valve member 248 is moved to a position that air under pressure is applied from port 246 to control port 258 of the control valve 253 for vacuum pump 259. This fluidly connects port 254 to port 256 for applying a vacuum to the bag pick-up cups. With the vacuum being applied through the pick-up cups and the cups engaging the adjacent upper side edge portion of a bag, due to the vertical accordian type construction of the cups, the bag pick-up edges of the cups move upwardly to move the grip portions of the bag therewith. At the same time, lower legs of the hold-down rods 52 exert a downward pressure on the upper side wall of the bag, leg **52*a* extending transversely on either side of cup 51*a* slightly forwardly thereof, leg 52*b* extending transversely on either side of cup 51*b* slightly to the rear thereof, and leg 52*c* extending transversely on either side of cup 51*c* slightly forwardly thereof. The approximate relative positions the lower legs 52*a*, 52*b* and 52*c* engage the bag on the magazine are indicated in FIG. 8 as positions 540, 541 and 542 respectively. This results in the gripped portions being moved upwardly a greater distance than the parts beneath the lower legs which also move beneath the lower legs as the gripped portions move upwardly. This movement of the bag results in the uppermost bag moving relative the next lower bag of the stack of bags on the magazine to insure separation of the upper bag from the stack when the swing arms are pivoted in the direction of arrow 520. As the bag pick-up cups have moved downwardly to a position engaging the uppermost bag of the stack of bags on the magazine that engage switch 470, the bracket 518 moves off of operator 280 and as a result, valve member 279 is resiliently returned to fluidly connect port 278 of the valve 276 to port 272 of the bag pick-up cylinder. This pivots rod 54 to engage arms 47 and pivot them in a direction opposite arrow 42** to elevate the bag pick-up cups which now have a bag grippingly engaged thereby.

Thereafter, the previously described air circuit from junction 308 through switches 306, 307, 293, the switch member 297 connecting ports 287, 286, and switch member of valve 301 to junction 282 is completed for applying air under pressure to the "up" port 328 of the bag transfer control valve 339 and to the "swing" control port 235 of the swing arm control valve 220. Applying air under pressure to port 235 results in swing cylinder 63 moving the piston rod 62 to move the swing arms toward the bag release position. As the swing arms move toward the bag release position, the one swing arm moves out of engagement with switch 476 so that switch member 478 moves to an open position for deenergizing the time delay relay if it is still energized, and switch member 477 moves to a closed position. After the swing arms have moved to the bag release position and limit switch 320 has been closed by a cam on the transfer tube 92 and clamp limit switch 322 has been closed by the operator 511 on the bag clamp piston rod as above indicated, air under pressure is applied to the "off" control port 250 of the bag pick-up control valve 243 whereby the control port 258 of vacuum control valve 253 is connected to exhaust port 247 and valve member 257 is then resiliently moved to discontinue the application of vacuum to manifold 60. As a result the pick-up cups release the pick-up bag to fall on the table to have the bag mouth edge portions vertically between the lower bag opening cups and the bag opening upper cups. When the bag is released by the pick-up cups, it is located between the longitudinally extending table top guides 524, 525 which are inclined downwardly and transversely toward one another to insure that the released bag is in a proper position on the table.

Referring to FIG. 8, the pick-up cups 51 grippingly engage a bag 527 at position 528 on the bag, positions 528 being adjacent the side edge 529. Edge 529 is the side edge of a bag on the magazine that is most closely adjacent guide 524 and it extends longitudinally.

When the pick-up cups are grippingly engaging a bag on the magazine and are in their elevated position with the swing arms in their pick-up position, the grippered portion is at a higher elevation than the stack of bags on the magazine and guide 524. When the gripped bag is moved by the pick-up cups in the direction of arrow 521, the opposite side edge portion will slide along the stack of bags at the pick-up position on the magazine and over guide 524 to fall into engagement with the table surface between guides 524, 525 before the bag is released by the pick-up cups. Upon discontinuation of the application of vacuum to the pick-up cups, the bag side edge portion 529 falls to the table adjacent guide 525. The maximum distance that any portion of the picked-up bag is elevated above the top surface of the table is substantially less than the width W of the bag whereby, when the bag is released by the pick-up cups, the side edges will be adjacent the guides 524, 525 and the bag mouth portion 530 will be forwardly of the bag bottom 534. Also, after the bag is released by the pick-up cups, the bag mouth portion will be beneath the upper opening cups so that when the upper opening cups are moved in their lowered position, cups 80 will engage the upper side wall 527*a* at portions 533, and cup 81 will engage the wall 527*a* at position 532 as indicated in FIG. 8. Further cups 76 engage the bag lower side wall mouth portion 527*b*.

At the time the bag is released by the pick-up cups and falls to the table, the bag transfer arms 95 have been swung in the direction of arrow 510 to their generally horizontal position; and provided switch 320 and spout clamped switch 322 are closed, air under pressure is applied to the return port 327 of the bag transfer control valve and the return control port 234 of the swing arm control valve whereby the swing arms are moved back to their bag pick-up position (after the bag has been released), and the transfer arms pivoted downwardly to their bag receiving position as previously indicated. As the transfer arms move downwardly, switch 373 is closed to apply air under pressure to down control port 368 for operating bag opening valve 364 to apply air under pressure to port 417 of the bag opening cylinder. This moves the upper pick-up cups downwardly. At the same time, air under pressure is applied to the on control port 385 of valve 386 to move valve member 387 so that air under pressure is applied to control port 383. This moves valve member 372 to apply a vacuum from pump 381 to the bag opening cups so that when the upper cups are moved into engagement with the upper side wall 527*a* of the bag on the table, the upper side wall is grippingly engaged by the upper cups and the lower bag side wall is grippingly engaged by the lower cups. Thereafter, as tube 92 continues to rotate in the direction opposite arrow 510, switch member 373 opens and valve member 369 is resiliently operated for applying fluid under pressure from port 363 to port 420 of cylinder 83. This moves the upper cups upwardly to open the bag's mouth. To be noted, is that prior to the upper cups being moved upwardly, the bag gripping edge of the middle cup 81 upon grippingly engaging the bag with a vacuum applied thereto moves upwardly a substantially greater distance than the bag gripping edges of the outer cups 80 while due to the more limited flexibility of the stems of the cups 80, the bag gripping edges of cups 80 move a limited amount inwardly toward one another and become slightly inclined upwardly and inwardly to permit the portion gripped by cup 81 to move a substantial distance above lower side wall 527*b* (see FIG. 10). This provides a small opening at the bag mouth portion to allow air to enter into the bag, and thus insure that the bag mouth is fully opened when the upper cups are moved upwardly by manifold 79 rather than either the lower side wall 527*a* separating from the lower cups 76 or the upper side wall separating from the upper cups as the manifold is elevated.

At the time the upper cups are being moved downwardly, air under pressure is applied to the "close" port 401 of the finger apart-closed valve 395 so that air under pressure is applied to port 413 of the cylinder 116. This results in the finger 98 on arm 97 being pivoted in a direction opposite arrow 118 and the finger 100 on arm 99 being pivoted in a direction opposite arrow 119 so that the fingers are moved more closely adjacent one another.

Before the transfer tube has rotated the transfer arms 95 to their bag receiving vertical position as viewed from the side, switch 373 opens, and when arms 95 are in their bag receiving position, a cam (not shown) on the transfer tube 92 closes switch 307. When switch 307 is closed and the opener up switch 306 is closed by guide rod 85 being moved to its up position (manifold 79 in the bag open position), air under pressure is applied to the "in" control port 428 to move valve member 429 to apply air under pressure to the finger cylinder ports 432 whereby the fingers are moved from the dotted line "out" position of FIG. 2 to the solid line "in" position of FIGS. 2 and 9 to extend into the opened bag mouth in the finger "closed" position.

At the same time air under pressure is applied to move the fingers to their "in" position, air under pressure is applied to the "apart" control port of valve 395 which results in air under pressure being applied to port 404 of cylinder 116. This pivots the transfer arms that are pivoted about member 94 in the direction of arrow 118, and these transfer arms in so pivoting through link 110 pivotally moving the other pair of transfer arms about pivot 101 in the direction of arrow 119 so that the finger arms and fingers are moved apart from one another from the dotted position of FIG. 11 to the solid line position thereof. The movement of the fingers apart from one another is limited by the size of the bag mouth opening, the fingers extending into the bag mouth as they are being spaced apart. It is to be noted that the fingers are of a width dimension X so that in their spread-apart position the bag mouth opening has a corresponding width dimension which is of a size of the bag mouth being slipped over the closed jaws of the spout as will be subsequently described. While the fingers are moving apart within the bag mouth, air under pressure is applied from junction 393 to "off" port 391 of valve 386 to move its valve member to a position for exhausting fluid from port 383 through port 390. Thereupon the valve member 372 of the control valve for vacuum pump 381 is resiliently moved to discontinue the application of vacuum to the opening cups so that they release the open bag whereby the bag on the table has its bag mouth portion supported in open condition only by the fingers.

If the movement of the fingers away from one another (finger 100 pivoting in the direction of arrow 119 and finger 98 pivoting in the direction of arrow 118) is not limited by both being properly extended into the bag mouth position in their apart position, one of the transfer plates 95 that is pivoted about pivot member 94 continues to pivot in the direction of arrow 118 past the finger 98 position of FIG. 11 to engage switch 293 and open this switch. Since in a cycle of operation unclamp solenoid valve 301 is not energized until after the fingers move to their apart position, the opening of switch 293 blocks continued automatic operation of the machine by not providing fluid under pressure to swing port 235 of the swing arm valve 220 and the up port 328 of the transfer valve 339. Other than when switch 284 is manually depressed to hold switch member 289 in a closed position, air under pressure is not applied to either of junctions 282, 283 when switch member 293 is in an open condition. This serves to prevent another bag from being picked up from the magazine and being released to be on top of a bag already on the table that was not either properly opened and/or had the fingers extended therein to supportingly retain the bag mouth portion in the position shown in FIG. 11.

After the bag mouth portion is supported in open condition only by the fingers, air under pressure has been applied in a manner previously indicated through switch member 306 and etc. to the transfer up control valve port 328 and through valve 339 to port 337 of cylinder 186 for retracting piston rod 187. As piston rod 187 is retracted, it moves the arms 148 predominantly longitudinally rearwardly, and since the rear ends of the arms 148 are pivotally connected at 147 to arms 146, the arms 146 are pivoted about shaft 91 in the direction of the arrow 510. This pivots the transfer tube 92 in the same direction. Additionally, as the arms 148 are moved generally rearwardly, pivot member 149 is moved in the same general direction to pivot arms 150 in the direction of arrow 730 about the axis of pivot member 151. The aforementioned mounting of arms 148 results in the front end portion of the arms moving in an arc that is downwardly and rearwardly to move the spout jaws away from the hopper scale 181 and thence move the front end portion of arms 148 upwardly and rearwardly to the bag transfer position illustrated in FIG. 5. As the spout jaws are being moved to a bag transfer position, the bag transfer assembly 90 is being pivoted in a direction of the arrow 510 so that the fingers 98, 100 with the bag thereon are moved to have the bag mouth portion extend around the lower portion of the closed spout jaws at the time the transfer tube 92 has been pivoted to its maximum position in the direction of arrow 510.

When the transfer tube is pivoted close to its maximum position in the direction of arrow 510 limit switch 320 is closed to apply air under pressure to the rear port of cylinder 175 in the manner previously indicated. This results in piston rod 174 being moved in the direction of the arrow 731 for pivoting angle irons 167 about pivot member 149 in the direction of the arrow 732 to bring the bag clamp 166 into clamping position with the fixed jaw 159. At the same time link 170 pivots the movable jaw 160 about pivot 161 in a direction opposite of the arrow 733 for clamping the opposite side wall of the bag between bag clamp 163 and the movable jaw. Thus the opposite side walls are clamped to the spout with the jaws in an open condition to have product discharged into the bag and at the same time to support the bag once the fingers are retracted from the bag mouth. Switch member 497 is mounted on bag clamps 163 so that if there is no bag being clamped to the spout, it will remain open, but if there is a bag being clamped to the spout, it will be closed by the bag being clamped. When switch member 497 and relay switch member 495 are both in a closed position the other scale controls 506 will be actuated for discharging the product from scale hopper 181.

As the spout is operated to its bag clamp position, operator 511 moves clamp switch 322 to a closed position as previously indicated and thereupon air under pressure to the return port 327 of the transfer valve and through the valve to cylinder 186 so that the transfer tube is pivoted in the direction opposite arrow 510. The last mentioned movement of the transfer tube results in the forward end of arms 148 being first swung downwardly and forwardly and thence upwardly and forwardly. As the arms 148 are moved in the aforementioned manner the spout is moved toward a position to extend under the hopper scale 181 and product is discharged to fall into the spout and thence therethrough into the bag. Accordingly, the product is being discharged from the hopper and through to the spout and into the bag prior to the arms 148 being moved to their forwardmost position, and thereby expediting the filling of the bag.

After the bag has been clamped between the bag holders and spout jaws, and up the spout clamp switch 322 being moved to a closed position, air under pressure is applied to "out" control port 427 for moving valve member 429 so that air under pressure is applied to ports 433 of the cylinder 105. This moves the fingers from their "in" position to their dotted line "out" position illustrated in FIG. 5 whereby the fingers are pivoted out of the bag before tube 92 is pivoted in the direction opposite arrow 510 to move the spout forwardly. Accordingly, as the spout having the bag clamped thereto is being moved forwardly, the fingers are clear of the bag so that the finger-transfer arm combination can be pivoted in the direction opposite arrow 510 and still clear the bag that is clamped to the spout.

As the transfer tube is pivoted in the direction opposite arrow 510 toward its bag receiving position, a cam on the tube (not shown) closes dump limit switch 482. When the transfer arms move to their bag receiving position, the cam moves off switch 482 and switch 482 opens. If the hopper scale contains the desired weight charge, coil 501 of the scale relay 485 will be energized to close switch member 486, and if the dump switch 482 is closed, the dump relay coil 481 will be energized to close switch member 484 to form a hold in circuit and switch member 495 will be closed so that through the other scale controls 506, the hopper scale will dump its charge into the spout. At this time, the bag has been clamped on the spout and is moving back toward its bag release position due to tube 92 being rotated in a direction opposite arrow 510. Further with switch 482 and switch member 486 closed, the timing relay coil 464 is energized so that after a selected elapsed period of time, switch member 465 is closed and retained in the closed position to retain solenoid operated control valve 301 energized in the manner previously indicated and after valve members 229 and 340 respectively shift due to air being applied at control port 235 of the swing arm valve and control port 328 of the bag transfer valve 339, the switch member is moved to its open position.

The time a bag is clamped on the spout is determined by setting of the time delay relay. The bag is released from the spout through the time delay switch member 465 moving to a closed position to energize unclamped valve 301 which when energized provides air under pressure to unclamp control port 348 for operating valve 343 to apply air under pressure to port 354 of cylinder 175. Thus bag holder 166 and jaw 160 are moved to their bag release, movable jaw closed positions and spout clamped switch 322 opening. The bag in being released results in switch member 497 opening. Valve 301 is retained in an energized condition through the time delay relay for a sufficient period of time to shift valve member 229 to a position to apply fluid under pressure to port 223 of swing valve 220, and valve member 340 to shift to apply fluid under pressure to port 337 of the bag transfer cylinder. Thus the machine continues to operate automatically.

At the time the last bag on the magazine in the stack at the bag pick-up position is picked up, the bag in place switch 470 resiliently returns its switch member 469 to an open position to deenergize solenoid valve 237 to prevent the swing arms moving from their release position to a pick-up position, and to close switch member 471. When the swing arms with the pick-up cups having the last bag of the stack gripped thereby move away from the swing arm bag pick-up positon, switch 476 resiliently moves switch member 478 to an open position and closes switch member 477 so that the magazine motor is energized for advancing another stack of bags to a bag pick-up position. Then another stack of bags when in place operates switch 470 to move switch member 471 so that the magazine motor is deenergized and switch member 469 closes. Thus the magazine motor only can be energized when the swing arms are out of their bag pick-up position.

To stop the machine, the electrical stop switch can be depressed to move switch member 447 to open the hold in circuit through switch member 457 and close switch member 494 so that if the no bag, no product switch 497 is closed, a weighed charge will be dumped into the bag. Now, or at any other time it is desired to release a bag clamped to the spout, switch 355 can be manually depressed to move switch member 361 to a closed position to apply air under pressure to unclamp port 348 of valve 343 whereby air is applied to cylinder 175 so that the movable jaw and bag holder 166 are moved to a bag release position.

Each of switches 306, 307, 320, 322 and 373 is of conventional construction that when its switch member is in an open condition, it is fluidly connected to an exhaust port.

The apparatus of this invention is of a construction for opening and filling plastic bags, for example made of polyethylene, and can be used with paper bags.

Figure 13:
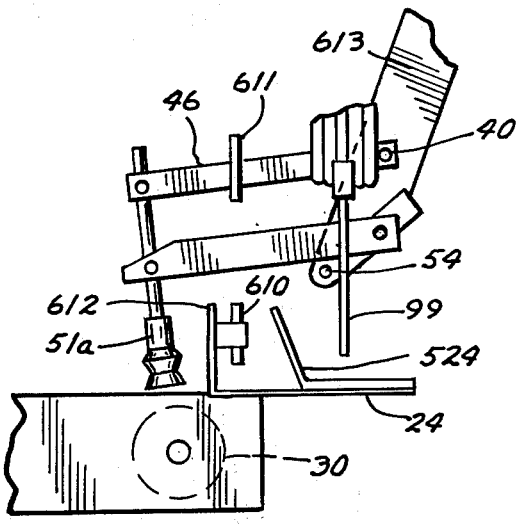
FIG. 13 is a fragmentary front view of the bag pick-up assembly in the position of FIG. 3 and illustrates the location of the electric eye light source and cell of the second embodiment; said view being generally taken along the line and in the direction of the arrows 13—13 of FIG. 12.

Referring now to FIGS. 12 and 13, the second embodiment of the invention, generally designated 600, is of the same construction as the first embodiment, other than for the differences set forth herein. In the second embodiment of the invention, the horizontal elongated pick-up arm shaft 602 of the bag pick-up assembly is longitudinally slidably mounted by bearings 601, one of the bearings being mounted by frame member 21 and the other bearing being mounted by frame member 20. The upper ends of the swing arms 603,604 are mounted on the shaft 602 in fixed axial positions relative to the shaft, but are rotatable relative the shaft. The lower ends of arms 603,604 mount rods 40 and 41, and the other structure that was described with reference to the first embodiment.

For longitudinally shifting the shaft 602 along its longitudinal axis, a plate 605 is connected to one end of the shaft 602 and to the piston rod 606 of the piston cylinder combination 606,607. The cylinder is mounted by a cylinder mount 608 which in turn is mounted by frame member 21.

For controlling the operation of the cylinder, there is provided an electric eye unit, generally designated 609, that includes a light receiving cell 610 mounted on the longitudinally extending, vertical stop plate 612. The plate 612 is mounted on the bag support 24 adjacent the end of the magazine 27 that is mounted by frame member 19. The electric eye unit also includes a light source 611 which is mounted by a suitable bracket or rod (not shown) that in turn is mounted by the frame so that the light source will direct a beam of light 613 to impinge on the light cell. The cell and light source are mounted in vertical spaced relationship such that as a bag picked-up from the magazine by the pick-up cups is being transversely swung to a bag release position, the picked-up bag will pass through the beam of light, provided the bag is sufficiently far to the left as viewed in looking at FIG. 12.

Figure 14:
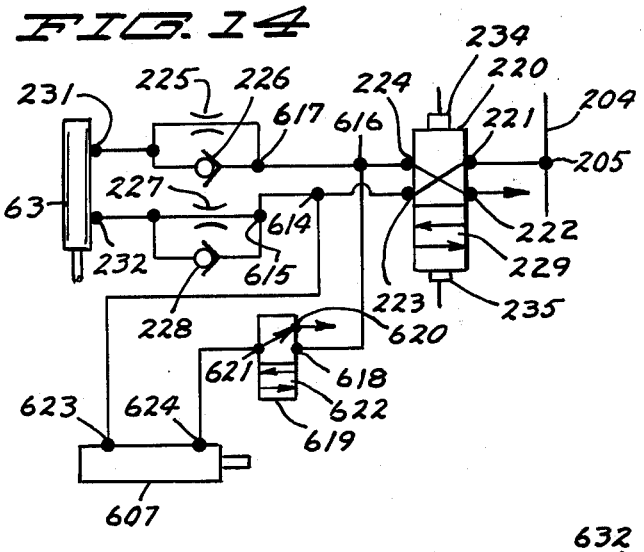
FIG. 14 is a fragmentary showing of the air control circuitry and components for the second embodiment of the invention.

Referring now to FIG. 14, for applying fluid under pressure to the two way acting cylinder 607, in the air circuitry of FIG. 6, a junction 616 is provided between port 224 of valve 220 and junction 617. The flow restrictor 225 and check valve 226 are connected in parallel between junction 617 and port 231 of cylinder 63 as previously described. Junction 616 is fluidly connected to the inlet port 618 of the solenoid operated air valve 619, valve 619 having an exhaust port 620, a port 621, and a valve member 622 that when the solenoid coil 633 of valve 619 is energized, moves to fluidly connect port 618 to port 621 and break the fluid connection between port 621 and the exhaust port. Upon the solenoid coil being deenergized, valve member 622 is resiliently returned to connect port 621 to port 620 and break the fluid connection between port 618 and port 621. The port 621 is fluidly connected to the port 624 of cylinder 607. Cylinder 607 also has a port 623 that is connected by a line to junction 614, junction 614 being provided in a line that fluidly connects port 223 of valve 220 to junction 615. The flow restrictor 227 and a check valve 228 are connected in parallel across junction 615 and port 232 of cylinder 63.

Figure 15:
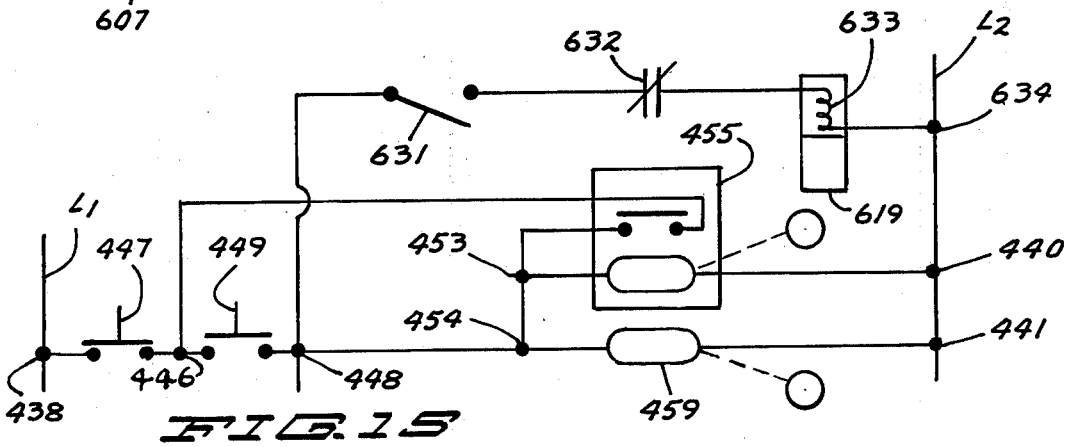
FIG. 15 is a fragmentary schematic showing of the electrical circuitry for the second embodiment of the invention.

Referring now to FIG. 15 the electric circuitry of the second embodiment is the same as that of the first embodiment other than there is provided a junction 634 on main line $L_2$. The solenoid coil 633 of valve 619, the electric eye switch member 632 of the electric eye device 609, and switch member 631 are connected in series across junction 634 and junction 448.

As long as the beam of light between the light source 611 and the cell 610 is not broken, switch 632 remains closed, but upon the beam of light being broken by a bag having a portion thereof extended therebetween, switch 632 opens and remains open until the bag is passed through and beyond the beam of light. Switch 631 has an operator 637 located in the path of movement of the swing arm 604 as it is moved between the bag pick-up and the bag release position. After the swing arms have been pivoted about the axis of the shaft 602 a sufficient amount for the bag, if its in proper longitudinal relationship, to break the beam of light, the arm 604 engages operator 637 to close switch 631; and after the arm 604 has been moved about half-way from its bag pick-up position to its bag release position, the arm moves past operator 637 so that the switch 631 is resiliently returned to an open position. Switch 631 is resiliently opened prior to the time that the bag has been moved sufficiently by the bag pick-up assembly to be entirely to the right of the beam of light as it would be viewed in FIG. 13.

In the event the bag on the magazine is not sufficiently far enough to the left as viewed in FIG. 12 so that the bag being picked-up by the pick-up assembly, transversely moved (without being longitudinally moved), and upon being released on table 24 would be in a proper position to have its mouth portion opened by the bag opening assembly and the fingers extended thereinto for transferring the bag, the beam of light is not broken at the time switch 631 is initially closed. As a result solenoid coil 633 is energized so that as fluid under pressure is being applied to port 231 of the swing cylinders 63, fluid under pressure is applied to port 624 of cylinder 607. This results in piston rod 606 moving in the direction of the arrow 635 (see FIG. 12) to shift the bag that is being gripped by cups 51 to the left as viewed in FIG. 12 for a limited distance, for example one inch. The bag in being moved to the left breaks the electric eye beam whereby switch 632 opens and valve 619 is deenergized. As a result port 624 of the shift cylinder 607 is connected to the exhaust, but the piston rod 606 does not move at this time.

When air under pressure is applied to port 232 of the swing arm cylinder 63 for returning the swing arms from their bag released position to their bag pick-up position, air under pressure is also applied to port 623 of the shift cylinder 607 so that the piston rod 606 is moved in the direction opposite arrow 635 to its datum position. Even though the swing arm 604 in being returned to its bag pick-up position engages the operator 637, it does not close switch 631. With the structure of the second embodiment, in the event the bag that is picked up from the bag magazine should be offset to the right (as viewed in FIG. 12) on the bag magazine from the desired longitudinal position on the magazine, at the time the bag is being swung from the bag pick-up position to the bag release position, the bag is longitudinally shifted to the left to be in proper longitudinal alignment for beng opened, i.e. released to fall on the table to be in proper longitudinal relationship on the table for further operations.

What is claimed is:

1. In apparatus for removing an unopened flat folded bag, which includes opposite first and second side walls that have edge portions which at least in part define an openable bag mouth, from a magazine and filling the bag, a frame, bag support means on the frame for supporting an unopened bag, operable bag pick-up means mounted on the frame for movement between a bag pick-up position to pick up an unopened bag from the magazine and a bag release position to release the pick-up bag to be supported by the bag support means, the pick-up means including an elongated swing arm having a first end portion and a second end portion, an elongated horizontal shaft having the swing arm first end portion mounted thereon for pivotal movement about a horizontal axis, means for mounting the shaft on the frame, vacuum cup means for picking up a bag from the magazine, arm means having a first end portion pivotally mounting the cup means and a second end portion, means for pivotally mounting the arm means on the swing arm second end portion, power means mounted on the frame and connected to one of the means for pivotally mounting the arm means and the swing arm for moving the swing arm between a bag pick-up position adjacent the magazine and a bag release position remote from the magazine, and power means mounted on the swing arm for moving the arm means relative the swing arm to move the cup means between a lowered bag pick-up position and an elevated position, operable bag opening means at least in part mounted on the frame for gripping the opposite bag side walls of a bag on the bag support means, moving the gripped side walls to open the bag mouth and subsequently releasing the gripped side walls, an operable spout assembly for clampingly engaging a bag having an opened bag mouth, and releasing the clampingly engaged bag after the bag has been filled, means for mounting the spout assembly on the frame, operable bag transfer means on the frame for supportingly engaging the opened bag to retain the bag mouth open and after the bag is released by the bag opening means move the opened bag off the bag support means and transfer the opened bag to a position for being clampingly engaged by the spout assembly, and control means for operating the bag pick-up means to pick up a bag from the magazine and then release it, then operate the bag opening means to open the bag mouth, and while the bag mouth is open operate the bag transfer means to supportingly engage the bag and after the bag opening means releases the opened bag, move the opened bag to the spout assembly for being clampingly engaged by the spout assembly and operate the spout assembly to clampingly engage the opened bag after the bag has been moved to the spout assembly by the bag transfer means.

2. In apparatus for removing an unopened flat folded bag, which includes opposite first and second side walls that have edge portions which at least in part define an openable bag mouth, from a magazine and filling the bag, a frame, bag support means on the frame for supporting an unopened bag, operable bag pick-up means mounted on the frame for movement between a bag pick-up position to pick up an unopened bag from the magazine and a bag release position to release the picked-up bag to be supported by the bag support means, operable bag opening means at least in part mounted on the frame for gripping the opposite bag side walls of a bag on the bag support means, moving the gripped side walls to open the bag mouth and subsequently releasing the gripping side walls, an operable spout assembly for clampingly engaging a bag having an opened bag mouth, and releasing the clampingly engaged bag after the bag has been filled, means for mounting the spout assembly on the frame, operable bag transfer means on the frame for supportingly engaging the opened bag to retain the bag mouth open and after the bag is released by the bag opening means move the opened bag off the bag support means and transfer the opened bag to a position for being clampingly engaged by the spout assembly, the bag transfer means including an elongated transfer member mounted on the frame for pivotal movement about a transverse horizontal axis, a first finger insertable into the opened bag mouth, a second finger insertable into the open bag mouth, a first elongated arm member, a second elongated arm member, each of said arm members having a first end portion and a second end portion, first pivot means for mounting the first arm first end portion on the transfer member for pivotally movement about an axis generally perpendicular to the transfer member axis, second pivot means for mounting the second arm first end portion in substantial transverse spaced relationship from the first pivot means for pivotal movement about an axis generally parallel to the first means pivot axis, means for mounting the first finger on the first arm second end portion to move therewith, means for mounting the second finger on the second arm second end portion to move therewith, and operable means for pivoting the arm members in opposite angular directions about the first and second pivot means for moving the fingers between a close position, and an apart position to support and retain a bag mouth in an open position, and operable means for pivoting the transfer member between a bag receiving position and a bag transfer position, and control means for operating the bag pick-up means to pick up a bag from the magazine and then releases it, then operate the bag opening means to open the bag mouth, and while the bag mouth is open operate the bag transfer means to supportingly engage the bag and after the bag opening means releases the opened bag, move the opened bag to the spout assembly for being clampingly engaged by the spout assembly and operate the spout assembly to clampingly engage the opened bag after the bag has been moved to the spout assembly by the bag transfer means, the control means including means to operate the transfer arm pivoting means to pivot the arm members to move the fingers to their close position prior the transfer member being moved to its bag receiving position and after the transfer member is in its bag receiving position and the bag mouth is opened, move the fingers apart.

3. The apparatus of claim 2 further characterized in that each of the means for mounting a finger includes a finger arm having a first end portion, and a second end portion mounting the respective finger and a pivot member having a pivot axis that extends in a direction that is generally perpendicular to both the direction of elongation of respective transfer member and the pivotal axis of the respective first and second pivot means, each of the finger arm second end portions being attached to the respective pivot member, and operable means on the arm members for pivoting the finger arms relative the arm members about the respective pivot member axis between an out position that the fingers are exterior of the open bag mouth and an in position that the fingers extend into the opened bag mouth when the first mentioned transfer member is in its bag receiving position, and that the control means includes means for operating the finger arm operable means to move the fingers arms between their in and out positions.

4. In apparatus for removing an unopened flat folded bag, which includes opposite first and second side walls that have edge portions which at least in part define an openable bag mouth, from a magazine and filling the bag, a frame, bag support means on the frame for supporting an unopened bag, operable bag pick-up means mounted on the frame for movement between a bag pick-up position to pick up an unopened bag from the magazine and a bag release position to release the picked-up bag to be supported by the bag support means, operable bag opening means at least in part mounted on the frame for gripping the opposite bag side walls of a bag on the bag support means, moving the gripped side walls to open the bag mouth and subsequently releasing the gripped side walls, an operable spout assembly for clampingly engaging a bag having an opened bag mouth, and releasing the clampingly engaged bag after the bag has been filled, means for mounting the spout assembly on the frame, operable bag transfer means on the frame for supportingly engaging the opened bag to retain the bag mouth open and after the bag is released by the bag opening means move the opened bag off the bag support means and transfer the opened bag to a position for being clampingly engaged by the spout assembly, the spout assembly being movable between a bag release position and a bag receiving position remote therefrom and including a pair of generally horizontally elongated arms having first end portions and second end portions, cooperative bag holder spout means mounted on the arms first end portions for clampingly receiving an opened bag from the bag transfer means when the spout assembly is in its bag receiving position and releasing a filled bag at the spout assembly bag release position, first arm members having first end portions pivotally connected to the frame, and second end portions pivotally connected to the first arms first end portions, a transfer member rotatably mounted on the frame, second arm members having first end portions fixedly attached to the transfer member to rotate therewith and second end portions pivotally connected to the arms second end portions, the bag transfer means including a first and a second finger that are insertable in the opened bag mouth, and means mounted on the transfer member to move therewith and relative thereto for mounting and moving the fingers between adjacent positions extending into the opened bag mouth and a spread apart position to supportingly retain the bag mouth in an open condition when the spout assembly is in a bag release position, and to move the fingers out of the bag mouth when the opened bag has been clampingly received by the bag holder spout means and the spout assembly is in a bag receiving position, and control means for operating the bag pick-up means to pick up a bag from the magazine and then release it, then operate the bag opening means to open the bag mouth, and while the bag mouth is open operate the bag transfer means to supportingly engage the bag and after the bag opening means releases the opened bag, move the opened bag to the spout assembly for being clampingly engaged by the spout assembly and operate the spout assembly to clampingly engage the opened bag after the bag has been moved to the spout assembly by the bag transfer means, the control means including means for moving the spout assembly between its positions.

5. The apparatus of claim 4 further characterized in that the transfer member has a generally horizontal axis of rotation and that the means mounted on the transfer member for movement therewith and relative thereto includes means for mounting the first finger on the transfer member for pivotal movement about a pivot axis perpendicular to the transfer member axis, means for mounting the second finger on the transfer member for pivotal movement about a pivot axis parallel to the first finger mounting means pivot axis and perpendicular to the transfer member axis, and operable means for pivoting the first and second mounting means for moving the fingers between their adjacent position and their apart position.

6. In apparatus for removing an opened flat folded bag, which includes opposite first and second side walls that have edge portions which are at least in part define an openable bag mouth and the second bag side wall has second and third edges that extend generally perpendicular to the second side wall bag mouth edge, from a magazine and filling the bag, a frame, bag support means on the frame for supporting an unopened bag, the bag support means being a table having a generally horizontal bag supporting surface for supportingly engaging a major portion of the first bag side wall, operable bag pick-up means mounted on the frame for movement between a bag pick-up position to pick up an unopened bag from the magazine and a bag release position to release the picked-up bag to be supported by the bag support means, operable bag opening means at least in part mounted on the frame for gripping the opposite bag side walls of a bag on the bag support means, moving the gripped side walls to open the bag mouth and subsequently releasing the gripped side walls, the bag opening means comprising a lower vacuum cup means adjacent the table supporting surface for grippingly engaging the first bag side wall adjacent the bag mouth edge portions while the bag is being supportingly engaged by the bag supporting surface, upper vacuum cup means for grippingly engaging the second side wall adjacent the bag mouth edge portions, and means for moving the upper cup means between a lowered position to grippingly engage the second side wall when the bag is on the bag support means and an elevated bag mouth open position, the upper vacuum cup means including a first, a second and third upper vacuum cup, and a vacuum manifold for applying a vacuum to the vacuum cups and mounting the second cup between the first and third cups and in a position to engage the second side wall more remote from the side wall second and third edges than the respective one of the first and third cups, the upper vacuum cups having lower bag engaging peripheral edges that are at about the same elevation when no vacuum is applied thereto and the second cup being of a substantially greater flexibility than the first and third cups so that when the upper cups engage the second side wall and a vacuum is applied thereto, the second vacuum cup bag engaging edge moves substantially more remote from the bag supporting surface than the first and third cup bag engaging edges, an operable spout assembly for clampingly engaging a bag having an opened bag mouth, and releasing the clampingly engaged bag after the bag has been filled, means for mounting the spout assembly on the frame, operable bag transfer means on the frame for supportingly engaging the opened bag to retain the bag mouth open and after the bag is released by the bag opening means move the opened bag off the bag support means and transfer the opened bag to a position for being clampingly engaged by the spout assembly, and control means for operating the bag pick-up means to pick up a bag from the magazine and then release it, then operate the bag opening means to open the bag mouth, and while the bag mouth is open operate the bag transfer means to supportingly engage the bag and after the bag opening means releases the opened bag, move the opened bag to the spout assembly for being clampingly engaged by the spout assembly and operate the spout assembly to clampingly engage the opened bag after the bag has been moved to the spout assembly by the bag transfer means.

7. The apparatus of claim 6 further characterized in that the lower cup means includes a lower manifold mounted in a fixed position and lower vacuum cups mounted by the lower manifold and that the means for moving the upper cup means comprises means mounted on the frame for vertically translating the upper cup means.

8. The apparatus of claim 7 further characterized in that the bag pick-up means includes vacuum pick-up cup means for grippingly engaging a bag, means for mounting the pick-up cup means and transversely swinging the pick-up cup means about a longitudinal horizontal axis between a bag pick-up position and a bag release position, and operable means for longitudinally shifting the pick-up cup mounting means in a given direction as the pick-up cup means are swung to the bag release position, and that the control means includes means for operating the last mentioned operable means as the pick-up cup means are moved from their bag pick-up position to move the pick-up cup means in said given direction in the event the picked-up bag is longitudinally offset in a direction opposite said given direction for being properly opened by the bag opening means when the bag is released unto the support means.

9. In apparatus for picking up a bag from a stack of bags in generally flat folded relationship with one bag vertically above another on a magazine and moving the picked-up bag to a bag support, a frame and a bag pick-up assembly mounted on the frame for movement between a position for picking up a bag from the magazine and a position to release the picked-up bag to be supported by the bag support, the pick-up assembly including a pair of elongated swing arms having first end portions and second end portions, an elongated horizontal shaft having the swing arm first end portions mounted thereon for pivotal movement about a horizontal axis, means for mounting the shaft on the frame, a plurality of vacuum cup means for picking up a bag from the magazine, separate arm means for each pick-up cup means having first end portions pivotally mounting the respective cup means and second end portions, means for pivotally mounting the arm means second end portions on the swing arms second end portions, means mounted on the frame and connected to one of the means for pivotally mounting the arm means and the swing arms for moving the swing arms between a bag pick-up position adjacent the magazine and a bag release position remote from the magazine, and means mounted on the swing arms for moving the arm means relative the swing arms to move the cup means between a lowered bag pick-up position and an elevated position.

10. The apparatus of claim 9 further characterized in that each of the arm means includes a vacuum cup mounting arm having a first end portion and a second end portion pivotally mounted by the art pivotally mounting means, means for pivotally connecting one of the cup means to the respective cup mounting arm, and that the means for moving the arm means includes a horizontally elongated member extending beneath the cup mounting arms and power operated means mounted by the swing arms for moving the horizontally elongated member between a lowered position and an elevated position to pivot the cup mounting arms relative the swing arms.

11. The apparatus of claim 9 further characterized in that each vacuum cup means includes a vacuum tube and an accordian type vacuum cup havng a peripheral bag engaging edge movable between a datum position relative the tube and a second position substantially move closely adjacent the tube when a vacuum is applied through the tube to the cup, and that there is provided for each vacuum cup, a hold down bar that when a vacuum is applied to the cup in gripping engagement with a bag on the magazine extends to a lower elevation than the cup peripheral edge, and that when no vacuum is applied to the cup, is at a minimum elevation that is higher than the cup peripheral edge portion, and means for selectively applying a vacuum through the tubes to the cups.

12. The apparatus of claim 9 further characterized in that the means for mounting the shaft includes means for mounting the shaft on the frame for pivotal movement about said axis and also for reciprocal horizontal movement in the direction of elongation of said shaft, and that there is provided operable means for reciprocally moving the shaft in the direction of elongation of said shaft.

13. The apparatus of claim 12 further characterized in that there is provided control means for controlling the operation of the means for moving the swing arms and the shaft moving means, the control means including means for sensing a bag on the pick-up cup means as the swing arms are moved from their bag pick-up position to their bag release position and in absence of sensing a bag operate the shaft moving means to a position that a bag is sensed.

14. In apparatus for transferring a bag having an opened mouth portion from a bag receiving position to a position extending around a closed spout, a frame, a horizontally elongated transfer member mounted on the frame for pivotal movement about a horizontal axis, a first finger, a second finger, each of the fingers being extendable into the open bag mouth portion, elongated means for mounting the first finger, elongated means for mounting the second finger, each of the finger mounting means having a first end portion and a second end portion, first pivot means mounting the first fingers mounting means first end portion on the transfer member for pivotal movement about a pivot axis that is generally perpendicular to the transfer member axis, second pivot means mounting the second finger mounting means first end portion on the transfer member for pivotal movement about a pivot axis that is generally perpendicular to the transfer member axis in spaced relationship to the first pivot means, the finger mounting means second end portions mounting the respective finger, means connected to the finger mounting means for moving the fingers relative one another between a finger together position for being extended into the bag mouth portion and an apart position that the fingers are more substantially spaced from one another than in their finger together position to supportingly retain the bag mouth portion in an open condition when the fingers are extended thereinto, the means connected to the finger mounting means for moving the fingers comprising linkage means pivotally connected to the first finger mounting means and pivotally connected to the second finger mounting means for pivoting the first finger mounting means about the first pivot axis in one angular direction as the second finger mounting means pivots about the second pivot axis in the opposite angular direction, and power means connected to the transfer member and the second finger mounting means for pivoting the second finger mounting means about the second pivot axis, and means for pivoting the transfer member to move the finger mounting means between a bag receiving position and a position to have the bag mouth portion extended around the closed spout.

15. In apparatus for transferring a bag having an opened mouth portion from a bag receiving position to a position extending around a closed spout, a frame, a horizontally elongated transfer member mounted on the frame for pivotal movement about a horizontal axis, a first finger, a second finger, each of the fingers being extendable into the open bag mouth portion, elongated means for mounting the first finger, elongated means for mounting the second finger, each of the finger mounting means having a first end portion and a second end portion, first pivot means mounting the first fingers mounting means first end portion on the transfer member for pivotal movement about a pivot axis that is generally perpendicular to the transfer member axis, second pivot means mounting the second finger mounting means first end portion on the transfer member for pivotal movement about a pivot axis that is generally perpendicular to the transfer member axis in spaced relationship to the first pivot means, the finger mounting means second end portions mounting the respective finger, means connected to the finger mounting means for moving the fingers relative one another between a finger together position for being extended into the bag mouth portion and an apart position that the fingers are more substantially spaced from one another than in their finger together position to supportingly retain the bag mouth portion in an open condition when the fingers are extended thereinto, and means for pivoting the transfer member to move the finger mounting means between a bag receiving position and a position to have the bag portion extended around the closed spout, each of the finger mounting means including an elongated arm member having an end portion remote from the transfer member, a finger mounting arm having a first end portion and a second portion mounting the respective finger, and means mounting the finger arm first end portion on the arm member end portion for pivotal movement about a finger arm pivot axis that is perpendicular to both the direction of elongation of the respective arm member and the pivotal axis of the respective first and second pivot means axis, and means connected between the respective finger arm and the arm member for moving the finger relative the arm member about the finger arm axis.

16. The apparatus of claim 15 further characterized in that arm member moving means includes an operable piston cylinder combination connected between the arm members for moving the arm members, that each of the finger arm moving means includes an operable piston cylinder combination connected between the respective finger arm and arm member for moving the finger arm about the respective finger arm pivot axis between an in position and an out position, and that there is provided control means for operating the transfer member moving means to move the arm members from a position to have the bag extended around the closed spout to a bag receiving position, operating the finger moving means to move the fingers from their out position exterior of the bag mouth to their in position when the fingers are in their together position and the transfer member is in its bag receiving position and operate the arm member moving means for moving the fingers from their together position to their apart position when the fingers are in their in position and the transfer member is in its bag receiving position.

17. The apparatus of claim 16 in combination with a bag support member for supporting a flat folded bag having an upper side wall and a lower side wall on the support member, and a bag opener assembly that includes lower vacuum means on the bag support member for releasably grippingly engaging the lower side wall of a bag on the support member adjacent the bag mouth, upper vacuum means for releasably grippingly engaging the upper side wall of a bag on the support member adjacent the bag mouth, operable means mounted on the frame for moving the upper cup means between a lowered position to engage a bag on the support member, and an elevated position to open the bag mouth, and that the control means includes means for applying a vacuum to the vacuum means so that the vacuum means will grippingly engage a bag and discontinue the application of vacuum when the upper vacuum means is in its elevated position and the fingers have been moved from their out position to their in position and after the fingers have started to move from their together position toward their apart position.

18. The apparatus of claim 17 further characterized in that the upper vacuum means includes a manifold, three vacuum cups mounted on the manifold in depending relationship thereto with one cup being mounted intermediate the other two, each cup having a bag engaging peripheral edge, the intermediate cup being of a substantially greater flexibility so that its bag gripping edge will move substantially more closely adjacent the manifold than the bag gripping edges of the other two vacuum cups when the cups engage the bag upper side wall and a vacuum is applied therethrough.

19. For opening a bag on a bag support, said bag having upper and lower side walls that have edge portions defining a bag mouth, bag opening apparatus comprising a frame, a bag support for supportingly engaging the bag lower side wall, lower vacuum cup means on the support member for grippingly engaging the lower side wall edge portion when the lower side wall is on the support member, upper vacuum cup means for grippingly engaging the upper side wall edge portion when the bag is on the support member, and means mounted on the frame for moving the upper cup means between a lowered position to grippingly engage the upper side edge portion, and an elevated position to move the upper side wall portion relative the lower side wall portion when the lower side edge portion is grippingly engaged by the lower cup means to open the bag mouth, the upper cup means including a vacuum manifold, and a first, a second and a third vacuum cup mounted on the manifold in depending relationship thereto, the cups having a lower bag gripping peripheral edge portions, the second cup being mounted to grippingly engage the upper side wall edge portion intermediate the first and third cups and being of a greater flexibility than the first and third cups whereby when a vacuum is applied to the cups in the manifold lowered position with the cups in engagement with the upper side wall, the second cup peripheral edge moves to a substantially higher elevation than the first and third cup peripheral edges to permit air entering through the bag mouth portion.

20. The apparatus of claim 19 further characterized in that the bag support has an upper horizontal support surface, and that the lower cup means includes a lower manifold, and a pair of lower vacuum cups mounted by the lower manifold in a fixed position to extend slightly above the support surface.

21. In apparatus for filling a bag, a frame, a spout assembly movable between a bag receiving position and a bag release position remote therefrom, the spout assembly including cooperative bag holder spout means for clampingly receiving an opened bag when the spout assembly is in its bag receiving position and releasing a filled bag at the spout assembly bag release position, horizontally elongated means for mounting the spout means, the spout mounting means having a first end portion mounting the spout means and a second end portion, first arm means having first end portions pivotally connected to the spout mounting means first end portion and a second end portion pivotally mounted on the frame, a transfer member mounted on the frame for pivotal movement about a horizontal axis between a bag receiving position and a spout assembly bag release position, and an arm mounted on the transfer member to rotate therewith, the arm having a first end portion fixed to the transfer member and a second end portion pivotally attached to the spout mounting means second end portion, power operated means attached to one of the spout mounting means and the transfer member for moving them between bag receiving and spout assembly release positions, and a transfer assembly for supportingly engaging the bag mouth portion in an open condition when the spout assembly is adjacent its release position and transferring the supportingly engaged bag to the spout assembly when the spout assembly is in its bag receiving position, the transfer means including first and second bag mouth portion engaging means for supporting retaining the bag mouth portion in an open condition, elongated operable first and second transfer means for mounting the first and second bag mouth engaging means respectively on the transfer member for movement therewith and relative thereto, and power operated means for operating the transfer means to move the first and second bag mouth engaging means to extend into the bag mouth portion and supportingly engage the bag mouth portion when the spout assembly is adjacent its release position and move the first and second bag mouth engaging means out of the bag mouth portion after the spout means has clampingly received the bag being supportingly engaged by the first and second bag mouth engaging means.

22. The apparatus of claim 21 further characterized in that each of the transfer means includes a bag mouth means arm member having a first end portion and a second end portion and pivot means for pivotally connecting the bag mouth means arm member first end portion to the transfer member to pivot therewith and relative thereto about an axis generally perpendicular to the axis of pivotal movement of the transfer member.

23. The apparatus of claim 22 further characterized in that each bag mouth means arm member has a second end portion mounting the respective bag mouth means to move therewith and that the means for operating the transfer means includes means for pivoting bag mouth means arm members about their respective pivot means to move the bag mouth means toward one, and alternately away from one another to supportingly engage the bag mouth portion when the bag mouth means extends into the bag mouth and the spout assembly is adjacent its release position.

24. The apparatus of claim 22 further characterized in that each bag mouth means arm member has a second end portion, that each bag mouth means includes a finger, and means for each finger pivotally mounting the finger on the respective bag mouth arm member for pivotal movement between a position that the finger is exterior of the bag mouth portion when the spout assembly is in its bag release position and a position extending into the bag mouth portion, and that the means for operating the transfer means includes power means for moving the fingers between their positions.

25. The apparatus of claim 24, further characterized in that there is provided a bag support having a generally horizontal supporting surface that is mounted on the frame, means on the frame for picking up an unopened flat folded bag from a position off of the bag support and release the picked up bag unto the bag support, and means on the frame for opening the bag mouth portion of the bag on the bag support for being supportingly engaged by the transfer assembly.

26. The apparatus of claim 25 wherein a bag on the bag support has upper and lower side walls that have bag mouth edge portions, further characterized in that the bag opening means includes lower vacuum cup means mounted on the bag support to grippingly engage the lower side wall mouth edge portion of a bag on the bag support, upper cup means for grippingly engaging the upper side wall mouth edge portion, and means for vertically translating the upper cup means between a lowered position to grippingly engage the upper side wall edge portion of a bag on the bag support and an elevated position to open the bag mouth.

27. In apparatus for picking up a bag from a stack of bags in generally flat folded relationship on a bag magazine and moving the picked-up bag transversely to a bag support member to be supported thereby in proper longitudinal relationship for further automatic handling of the bag, a frame, vacuum cup means for grippingly engaging a bag on the magazine at a bag pick-up position and releasing the gripped bag at a release position transversely remote from the magazine, means for mounting the cup means, operable means mounted on the frame mounting the cup mounting means on the frame for movement transversely from the bag pick-up position to the release position and longitudinally moving the cup means, and control means for operating the operable means to move the mounting means for the vacuum cup means to move the vacuum cup means transversely from their bag pick-up position to their release position and in the event the grippingly engaged bag is longitudinally offset in one given direction from a given position on the magazine before it is picked-up, move the mounting means for the vacuum cup means longitudinally a limited amount in a direction opposite said given direction.

28. The apparatus of claim 27 further characterized in that the mounting means for the vacuum cup means includes vacuum cup arm means having first end portions for mounting the vacuum cup means and second end portions, and means mounted by the operable means for mounting the arm means for movement relative thereto, and that the operable means includes first power operated means mounted by the means for mounting the arm means to move the arm means between a lowered position that the vacuum cup means engages a bag on the magazine and an elevated position when the first mentioned mounting means is at its bag pick-up position.

29. The apparatus of claim 28 further characterized in that the operable means includes second power operated means for moving the mounting means for the arm means between a position the vacuum cup means is adjacent the magazine and a position the vacuum cup means is adjacent the bag support member.

30. The apparatus of claim 28 further characterized in that the operable means includes a shaft having a longitudinal, horizontal axis, means mounted on the frame for mounting the shaft for longitudinal movement and power means for moving the shaft longitudinally, and that the control means includes means for sensing a bag in proper longitudinal relationship as the bag is moved from the magazine to the bag support member, and in the event the bag is longitudinally offset in said given direction, operate the power means to longitudinally move the shaft in a direction opposite said given direction.

31. The apparatus of claim 30 further characterized in that means for mounting the vacuum cup means includes arm means pivotally mounted on the shaft in fixed axial relationship thereto for mounting and pivotally moving the vacuum cup means from a position adjacent the magazine to a position that is transversely spaced from the position adjacent the magazine and is adjacent the bag support member, and that the operable means includes second power operated means on the frame for pivoting the arm means relative the shaft.

32. The apparatus of claim 31 further characterized in that the sensing means includes electric eye means emitting a beam of light that is broken by a bag in proper longitudinal relationship as the bag is moved from the magazine to the bag support member by the cup means, a switch that is closed by the arm during an interval that a grippingly engaged bag is moved from the magazine to the bag support member and after a bag in proper longitudinal relationship has broken the beam of light, and means coacting with the switch and electric eye means to actuate the first power operated means to move the shaft opposite said given one direction so that the bag on the vacuum means will break the beam of light in the event said switch is closed and the bag during its entire movement from the bag magazine to the bag support member would pass outside the beam of light.

33. In apparatus for picking up a bag from a stack of bags in generally flat folded relationship with one bag vertically above another on a magazine and moving the picked-up bag to a bag support, a frame and a bag pick-up assembly mounted on the frame for movement between a position for picking up a bag from a magazine and a position to release the picked-up bag to be supported by the bag support, the pick-up assembly including an elongated swing arm having a first end portion and a second end portion, an elongated horizontal shaft having the swing arm first end portion mounted thereon for pivotal movement about a horizontal axis, means for mounting the shaft on the frame, a plurality of vacuum cup means for picking up a bag from the magazine, means for mounting the cup means on the swing arm second end portion, means mounted on the frame and connected to one of the swing arm and the means for mounting the cup means for moving the swing arm between a bag pick-up position adjacent the magazine and a bag release position remote from the magazine, each vacuum cup means including vacuum tube and an accordian type vacuum cup having a peripheral bag engaging edge movable between a datum position relative the tube and a second position substantially more closely adjacent the tube when a vacuum is applied to the cup, a hold bar for each vacuum cup mounted by the means for mounting the vacuum cup means that when a vacuum is applied to the cup in gripping engagement with a bag on the magazine extends to a lower elevation than the cup peripheral edge, and that when no vacuum is applied to the cup, is at a minimum elevation that is higher than the cup peripheral edge portion, and means for selectively applying a vacuum through the tubes to the cups.

34. The apparatus of claim 33 further characterized in that the means for mounting the vacuum cup means comprises means for mounting the vacuum cups on the swing arm for movement relative thereto, and means mounted on the swing arm for moving the means for mounting the vacuum cups to move the cups between a lowered bag pick-up position and an elevated position.

* * * * *

UNITED STATES PATENT AND TRADEMARK OFFICE

CERTIFICATE OF CORRECTION

PATENT NO. : 4,182,094

DATED : 1/8/80

INVENTOR(S) : Gaylerd M. Lieder & Richard H. Ayres

It is certified that error appears in the above-identified patent and that said Letters Patent are hereby corrected as shown below:

Column 8, line 27, after "when", insert --tube--.

Column 26, line 33, change "art" to --arm--.

Signed and Sealed this

*Twenty-fifth* Day of *March 1980*

[SEAL]

*Attest:*

SIDNEY A. DIAMOND

*Attesting Officer*

*Commissioner of Patents and Trademarks*